US009683401B2

(12) United States Patent
Smith

(10) Patent No.: US 9,683,401 B2
(45) Date of Patent: Jun. 20, 2017

(54) JACKET FOR AUTOMATED TELLER MACHINE AND RELATED METHODS

(71) Applicant: ECLIPSE CASH SYSTEMS, LLC, Chandler, AZ (US)

(72) Inventor: Derek Smith, Tempe, AZ (US)

(73) Assignee: ECLIPSE CASH SYSTEMS, LLC, Chandler, AZ (US)

( * ) Notice: Subject to any disclaimer, the term of this patent is extended or adjusted under 35 U.S.C. 154(b) by 0 days.

(21) Appl. No.: 14/829,521

(22) Filed: Aug. 18, 2015

(65) Prior Publication Data

US 2015/0356834 A1 Dec. 10, 2015

Related U.S. Application Data

(63) Continuation of application No. PCT/US2014/017005, filed on Feb. 18, 2014.

(60) Provisional application No. 61/765,953, filed on Feb. 18, 2013.

(51) Int. Cl.

| | |
|---|---|
| ***E05G 1/024*** | (2006.01) |
| ***G07F 19/00*** | (2006.01) |
| ***E05B 65/00*** | (2006.01) |
| ***E05G 1/02*** | (2006.01) |

(52) U.S. Cl.

CPC ..... *E05G 1/024* (2013.01); *E05B 65/0075* (2013.01); *E05G 1/02* (2013.01); *G07F 19/205* (2013.01); *Y10T 29/49828* (2015.01)

(58) Field of Classification Search

CPC .. E05G 1/00; E05G 1/02; E05G 1/024; E05G 1/205; E05G 1/026; G07F 19/00; G07F 19/20; G07F 19/205

See application file for complete search history.

(56) References Cited

U.S. PATENT DOCUMENTS 4,158,338 A * 6/1979 Dippold ..... E05G 1/024 109/79
5,257,581 A * 11/1993 Welling ..... E05G 1/00 109/24
6,061,971 A * 5/2000 Wolters ..... E04H 1/14 312/265.3

(Continued)

FOREIGN PATENT DOCUMENTS

JP 07168963 7/1995
JP 2001351144 12/2001

(Continued)

OTHER PUBLICATIONS

International Search Report and Written Opinion for PCT/US2014/017005, dated Jun. 24, 2014.

(Continued)

*Primary Examiner* — Christopher Boswell
(74) *Attorney, Agent, or Firm* — Bryan Cave LLP

(57) ABSTRACT

Some embodiments include a system. The system includes a jacket having one or more armor panels. The jacket can be coupled to an exterior surface of an automated teller machine, the automated teller machine having the exterior surface and a vault that has a hollow interior. Further, when the jacket is coupled to the exterior surface of the automated teller machine, the jacket can prevent and/or deter unauthorized access to the hollow interior of the vault of the automated teller machine. Other embodiments of related systems and methods are also disclosed.

21 Claims, 15 Drawing Sheets

(56) References Cited

U.S. PATENT DOCUMENTS

| | | | | |
|---|---|---|---|---|
| 7,111,776 | B2 * | 9/2006 | Schoeffler | G06Q 20/1085 235/379 |
| 8,555,794 | B2 * | 10/2013 | Tamura | G07D 11/00 109/49.5 |
| 8,991,118 | B2 * | 3/2015 | Tunis, III | E05G 1/026 52/202 |
| 2009/0249986 | A1 * | 10/2009 | Joanis | E05G 1/02 109/24 |
| 2012/0090452 | A1 * | 4/2012 | Sudhakar | B29C 70/46 89/36.02 |
| 2012/0186086 | A1 * | 7/2012 | Tavares De Pinho | E05G 1/024 29/897.34 |
| 2012/0222590 | A1 * | 9/2012 | Marques | E05G 1/024 109/78 |
| 2013/0233211 | A1 * | 9/2013 | Tavares de Pinho | E05G 1/024 109/51 |
| 2014/0096709 | A1 * | 4/2014 | McGunn | E05G 1/02 109/52 |

FOREIGN PATENT DOCUMENTS

| | | |
|---|---|---|
| JP | 2002030860 | 1/2002 |
| JP | 2007011480 | 1/2007 |
| KR | 1020090088593 | 8/2009 |

OTHER PUBLICATIONS

ATM Kiosks and Enclosures, http://tpitexas.com/product-gallery/; copied Nov. 16, 2015.

* cited by examiner

JACKET FOR AUTOMATED TELLER MACHINE AND RELATED METHODS

CROSS-REFERENCE TO RELATED APPLICATIONS

This application is a continuation of International Patent Application No. PCT/US2014/017005, filed Feb. 18, 2014, and which claims the benefit of U.S. Provisional Patent Application No. 61/765,953, filed Feb. 18, 2013. International Patent Application No. PCT/US2014/017005 and U.S. Provisional Patent Application No. 61/765,953 are incorporated herein by reference in their entirety.

FIELD OF THE INVENTION

This invention relates generally to systems for protecting automated teller machines, and relates more particularly to such systems for effectively and affordably protecting automated teller machines from thieves and methods of providing the same.

DESCRIPTION OF THE BACKGROUND

Automated teller machines were first used by financial institutions to handle financial transactions as early as the 1960s and have since become a staple of the industry. For nearly as long, thieves have been targeting automated teller machines to steal money contained within the automated teller machines. Mobile automated teller machines are generally designed to be light and portable, but are especially vulnerable to theft, particularly when located at outdoor venues and away from buildings. For example, thieves drill out or cut the automated teller machines, gaining access to the money machines via brute force approaches like hammering or ramming the automated teller machines with vehicles, or even in some cases, taking entire automated teller machines to be raided at safer locations. Nonetheless, conventional systems and methods for securing automated teller machines have routinely proven inadequate and/or non-cost effective. Accordingly, improved systems and methods for effectively and affordably securing automated teller machines are needed.

BRIEF DESCRIPTION OF THE DRAWINGS

To facilitate further description of the embodiments, the following drawings are provided in which.

Figure 1:
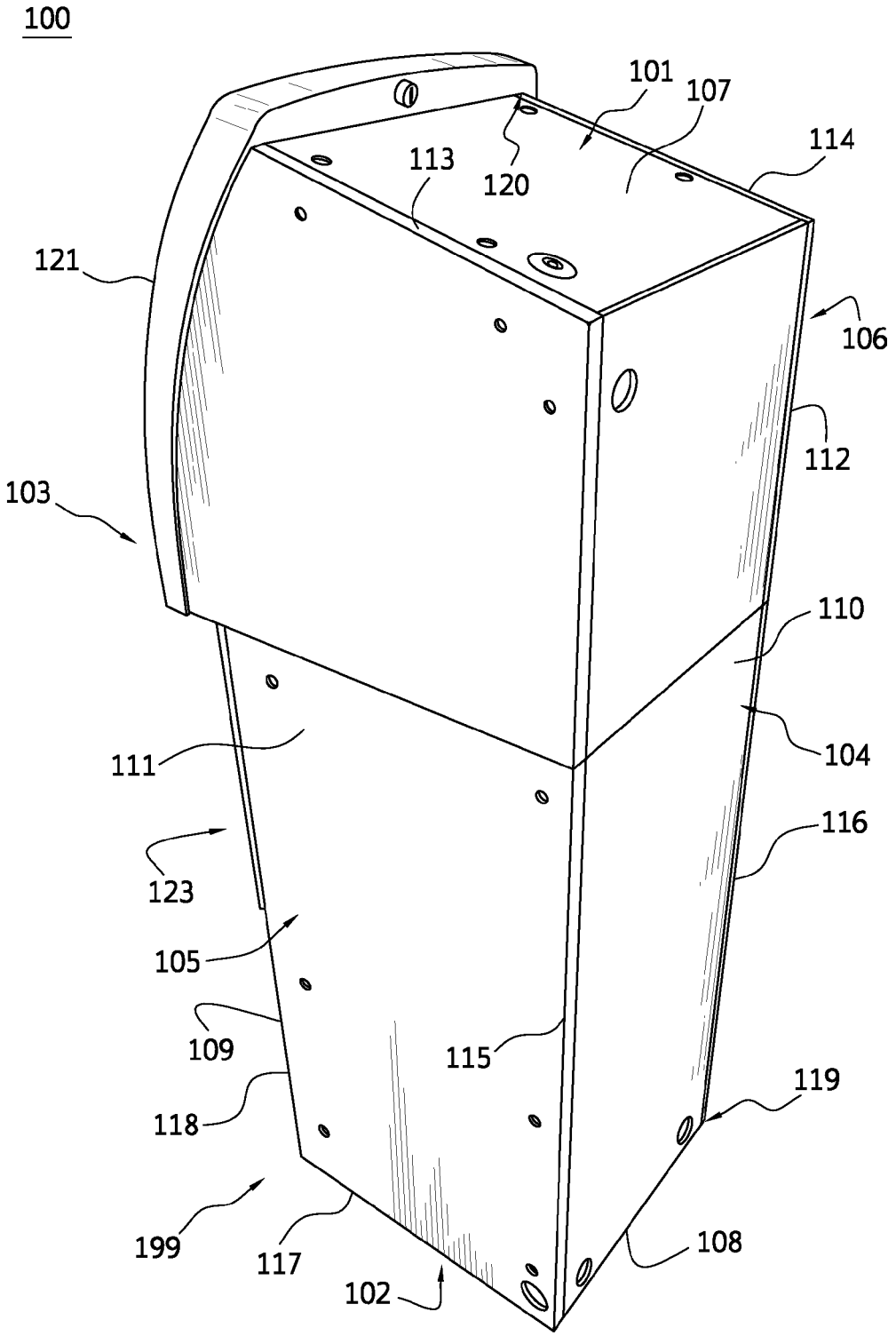
FIG. 1 illustrates a top, right, rear side isometric view of an automated teller machine (ATM)

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise. Two or more electrical elements may be electrically coupled but not be mechanically or otherwise coupled; two or more mechanical elements may be mechanically coupled, but not be electrically or otherwise coupled; two or more electrical elements may be mechanically coupled, but not be electrically or otherwise coupled. Coupling may be for any length of time, e.g., permanent or semi-permanent or only for an instant.

"Electrical coupling" and the like should be broadly understood and include coupling involving any electrical signal, whether a power signal, a data signal, and/or other types or combinations of electrical signals. "Mechanical coupling" and the like should be broadly understood and include mechanical coupling of all types.

The absence of the word "removably," "removable," and the like near the word "coupled," and the like does not mean that the coupling, etc. in question is or is not removable.

DETAILED DESCRIPTION OF EXAMPLES OF EMBODIMENTS

Some embodiments include a system. The system comprises a jacket comprising one or more armor panels. The jacket is configured to be coupled to an exterior surface of an automated teller machine, and the automated teller machine comprising a vault that comprises a hollow interior. Meanwhile, when the jacket is coupled to the exterior surface of the automated teller machine, the jacket is configured to at least one of prevent or deter unauthorized access to the hollow interior of the vault of the automated teller machine.

Further embodiments include a method of providing a jacket for an automated teller machine. The automated teller machine comprises an exterior surface and a vault that comprises a hollow interior. Meanwhile, the method can comprise: providing one or more armor panels; and configuring the jacket such that the jacket is able to at least partially enclose the automated teller machine and such that when the jacket is at least partially enclosing the automated teller machine, the jacket is configured to at least one of prevent or deter unauthorized access to the hollow interior of the vault of the automated teller machine.

Other embodiments include a method of providing jacket for an automated teller machine. The automated teller machine comprises a vault that comprises a hollow interior. The method can comprise: providing one or more armor panels; and configuring the jacket such that the jacket is able to be coupled to an exterior surface of the automated teller machine and such that when the jacket is coupled to the exterior surface of the automated teller machine, the jacket is configured to at least one of prevent or deter unauthorized access to the hollow interior of the vault of the automated teller machine.

Many embodiments include a system. The system comprises a jacket comprising one or more armor panels. The jacket can be coupled to an exterior surface of an automated teller machine, and the automated teller machine can comprising the exterior surface and a vault that comprises a hollow interior. Meanwhile, when the jacket is coupled to the exterior surface of the automated teller machine, the jacket can be configured to prevent and/or deter unauthorized access to the hollow interior of the vault of the automated teller machine.

In these or other embodiments, the one or more armor panels can comprise a front armor panel, a rear armor panel, a right armor panel, and a left armor panel, and at least one of the one or more armor panels can be coupled to the exterior surface of the automated teller machine in order to couple the jacket to the exterior surface of the automated teller machine. The one or more armor panels can comprise a discrete element comprising the front armor panel, and the one or more armor panels can comprise an aggregate element comprising the rear armor panel, the right armor panel, and the left armor panel. Further, the exterior surface of the automated teller machine can comprise one or more side panels, and the one or more armor panels can be harder than the one or more side panels. Also, at least one of the right armor panel can comprise a right foot, the left armor panel can comprise a left foot, or the rear armor panel can comprise a rear foot, and at least one of the right foot, the left foot, or the rear foot can be coupled to an other surface separate from the jacket and the automated teller machine in order to anchor the jacket to the other surface. Further still, the jacket can be bolted to the exterior surface of the automated teller machine in order to couple the jacket to the exterior surface of the automated teller machine.

Some embodiments include a system. The system comprises a jacket comprising one or more armor panels, and the armor panel(s) comprise a top armor panel, a front armor panel, a rear armor panel, a right armor panel, and a left armor panel. At least one of the armor panel(s) is configured to be coupled to the exterior surface of the automated teller machine in order to couple the jacket to the exterior surface of the automated teller machine. Meanwhile, when the jacket is coupled to the exterior surface of the automated teller machine, the jacket is configured to at least one of prevent or deter unauthorized access to the hollow interior of the vault of the automated teller machine.

In these or other embodiments, the exterior surface of the automated teller machine can comprise one or more side panels, and the side panel(s) can comprise a top side panel, a front side panel, a rear side panel, a right side panel, and a left side panel. Meanwhile, the top armor panel can be welded to the right armor panel, the left armor panel, and the rear armor panel. Further, the front armor panel can be configured to be coupled to at least one of the front side panel, the right armor panel, the left armor panel, the right side panel, or the left side panel. Further still, the right armor panel can be configured to be coupled to the right side panel, and/or the left armor panel can be configured to be coupled to the left side panel. Also, the right armor panel and the left armor panel can extend from and be approximately perpendicular to the rear armor panel.

Further in these embodiments, the right armor panel can comprise a right foot and the left armor panel can comprise a left foot. The right foot and the left foot can be configured to be coupled to a ground surface in order to anchor the jacket to the ground surface. Also, the jacket can comprise a jacket locking mechanism and an engagement mechanism comprising a first engagement feature and a second engagement feature. Meanwhile, the jacket locking mechanism can be configured to be received at the engagement mechanism to couple the first engagement feature to the second engagement feature in order to maintain the front armor panel and the front side panel in a closed position.

Further embodiments include a system. The system comprises a jacket comprising one or more armor panels, and the armor panel(s) comprise a top armor panel, a front armor panel, a rear armor panel, a right armor panel, and a left armor panel. At least one of the armor panel(s) is configured to be coupled to the exterior surface of the automated teller machine in order to couple the jacket to the exterior surface of the automated teller machine. Meanwhile, when the jacket is coupled to the exterior surface of the automated teller machine, the jacket is configured to at least one of prevent or deter unauthorized access to the hollow interior of the vault of the automated teller machine.

In these or other embodiments, the exterior surface of the automated teller machine can comprise one or more side panels, and the side panel(s) can comprise a top side panel, a front side panel, a rear side panel, a right side panel, and a left side panel. Meanwhile, the top armor panel can be configured to be coupled to the right armor panel, the left armor panel, the right side panel, and the left side panel; the front armor panel can be configured to be coupled to at least one of the front side panel, the right armor panel, the left armor panel, the right side panel, or the left side panel; the rear armor panel can be configured to be coupled to the right armor panel, the left armor panel, the right side panel, and the left side panel; the right armor panel can be configured to be coupled to the right side panel; and the left armor panel can be configured to be coupled to the left side panel. Likewise, the top armor panel can comprise a top right wing and a top left wing opposite the top right wing, and the rear armor panel can comprise a rear right wing and a rear left wing opposite the rear right wing. The top right wing and the top left wing can extend from and approximately perpendicular to a central part of the top armor panel, and the rear right wing and the rear left wing can extend from and approximately perpendicular to a central part of the rear armor panel. Further, the top right wing can be configured to be coupled to the right armor panel to couple the top armor panel to the right armor panel; the top left wing can be configured to be coupled to the left armor panel to couple the top armor panel to the left armor panel; the rear right wing can be configured to be coupled to the right armor panel to couple the rear armor panel to the right armor panel; the rear left wing can be configured to be coupled to the left armor panel to couple the rear armor panel to the left armor panel.

Further in these or other embodiments, the right armor panel can comprise a top right trim extension and a rear right trim extension, and the left armor panel can comprise a top left trim extension and a rear left trim extension. Meanwhile, when the top right wing is coupled to the right armor panel, the top right trim extension can approximately abut the top right wing and the top right wing at least partially overlaps the right armor panel; when the top left wing is coupled to the left armor panel, the top left trim extension can approximately abut the top left wing and the top left wing at least partially overlaps the left armor panel; when the rear right wing is coupled to the right armor panel, the rear right trim extension can approximately abut the rear right wing and the rear right wing at least partially overlaps the right armor panel; and when the rear left wing is coupled to the left armor panel, the rear left trim extension can approximately abut the rear left wing and at least partially overlaps the left armor panel.

Further still in these or other embodiments, the right armor panel can comprise a right foot and the left armor panel can comprise a left foot. The right foot and the left foot can be configured to be coupled to a ground surface in order to anchor the jacket to the ground surface. Further, the jacket can comprise a jacket locking mechanism and an engagement mechanism comprising a first engagement feature and a second engagement feature. The jacket locking mechanism can be configured to be received at the engagement mechanism to couple the first engagement feature to the second engagement feature in order to maintain the front armor panel and the front side panel in a closed position.

Turning to the drawings, FIG. 1 illustrates a top, right, rear isometric view of automated teller machine (ATM) 100. ATM 100 can comprise any suitable automated teller machine. In many embodiments, ATM 100 can comprise a mobile automated teller machine.

For example, ATM 100 comprises vault 199. ATM 100 and/or vault 199 can comprise one or more sides. The side(s) can comprise top side 101, bottom side 102, front side 103, rear side 104, right side 105, and/or left side 106. Further, ATM 100 and/or vault 199 can comprise one or more side panels. The side panel(s) can comprise top side panel (SP) 107 at top side 101, bottom SP 108 at bottom side 102, front SP 109 at front side 103, rear SP 110 at rear side 104, right SP 111 at right side 105, and/or left SP 112 at left side 106. In some embodiments, bottom SP 108 can be omitted. In many embodiments, one or more of top SP 107, bottom SP 108, front SP 109, rear SP 110, right SP 111, and/or left SP 112 can comprise multiple sub-panels. In these embodiments, the multiple sub-panels of the respective ones of top SP 107, bottom SP 108, front SP 109, rear SP 110, right SP 111, and/or left SP 112 can form (e.g., can be coupled together to form) the respective ones of top SP 107, bottom SP 108, front SP 109, rear SP 110, right SP 111, and/or left SP 112. However, for convenience of description, top SP 107, bottom SP 108, front SP 109, rear SP 110, right SP 111, and/or left SP 112 are referenced herein as being single aggregate panels.

Meanwhile, top SP 107 can form top SP right edge 113 with right SP 111 and top SP left edge 114 with left SP 112. Further, rear SP 110 can form rear SP right edge 115 with right SP 111 and rear SP left edge 116 with left SP 112. Further still, right SP 111 can comprise right SP bottom edge 117 opposite top SP right edge 113, and also can comprise right SP front edge 118 opposite rear SP right edge 115; and/or left SP 112 can comprise left SP bottom edge 119 opposite top SP left edge 114, and can further comprise left SP front edge 120 opposite rear SP left edge 116.

Figure 6:
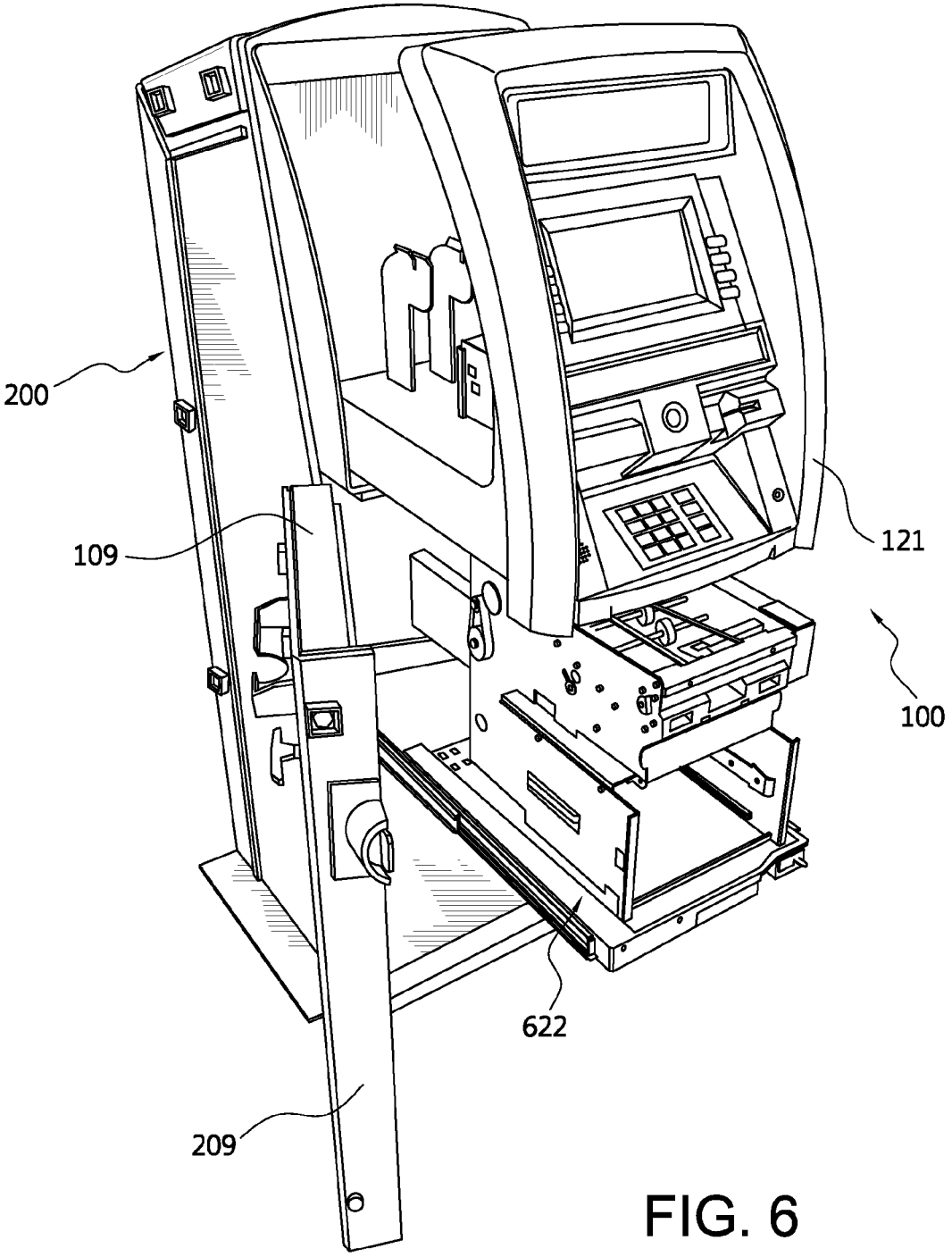
FIG. 6 illustrates the system of FIGS. 2-5 enclosing the ATM of FIG. 1 when a front side panel of a vault of the ATM of FIG. 1 and a front armor panel (AP) of the system are in the open position, according to the embodiment of FIGS. 2-5.

ATM 100 and/or vault 199 can comprise a hollow interior formed by top SP 107, bottom SP 108, front SP 109, rear SP 110, right SP 111, and/or left SP 112. In many embodiments, front SP 109 can be implemented as a door to provide access to at least part of vault 199. For example, front SP 109 can be coupled (e.g., via a hinge mechanism (not shown)) to one of right SP 111, left SP 112, or bottom side 102, and can be movable between an open position (i.e., providing access to vault 199 at front side 103) and a closed position (i.e., preventing access to vault 199). Further, ATM 100 can comprise user interface 121 and currency dispensing mechanism 622 (FIG. 6). Currency dispensing mechanism 622 (FIG. 6) can be located at (e.g., within) vault 199. Further, user interface 121 can be located at least partially within vault 199 and/or at least partially at front side 103, such as, for example, between top SP 107, right SP 111, left SP 112, and front SP 109 (i.e., when front SP 109 is configured in the closed position).

Currency dispensing mechanism 622 (FIG. 6) can be operable to provide any suitable functionality for administering currency exchange between ATM 100 and users of ATM 100. Further, user interface 121 can be operable to provide any suitable functionality permitting the users to operate ATM 100 and/or communicate with currency dispensing mechanism 622 (FIG. 6). That is, in many examples, currency dispensing mechanism 622 (FIG. 6) and/or user interface 121 comprise conventional components of automated teller machines and can be configured to operate accordingly.

In many embodiments, ATM 100 can be configured to prevent unauthorized access to the hollow interior of ATM 100. For example, ATM 100 can comprise one or more ATM locking mechanisms 123 (e.g., one or more combination locks, one or more electronic keypads, etc.), such as, for example, at front SP 109. When engaged, ATM locking mechanism(s) 123 can maintain front SP 109 in the closed position, preventing front SP 109 from being moved from the closed position to the open position. ATM locking mechanism(s) 123 can be configured so that only authorized personnel can readily and/or legally disengage ATM locking mechanism(s) 123 in order to access the vault via front SP 109.

Further, in various embodiments, front SP 109 can comprise a handle operable to facilitate movement of front SP 109 between the open and closed positions. Further still, front SP 109 can comprise a dispensing aperture configured to permit currency to be provided from currency dispensing mechanism 622 (FIG. 6) to the users of ATM 100. Also, front SP 109 can comprise a shield (not shown) configured to be positioned over ATM locking mechanism(s) 123, the handle, and/or the dispensing aperture of front SP 109. Accordingly, the shield can conceal ATM locking mechanism(s) 123, the handle, and/or the dispensing aperture of front SP 109 from view. In some embodiments, the shield can be implemented as a door and/or can be configured to be locked in a shield position concealing ATM locking mechanism(s) 123, the handle, and/or the dispensing aperture of front SP 109 from view.

Figure 2:
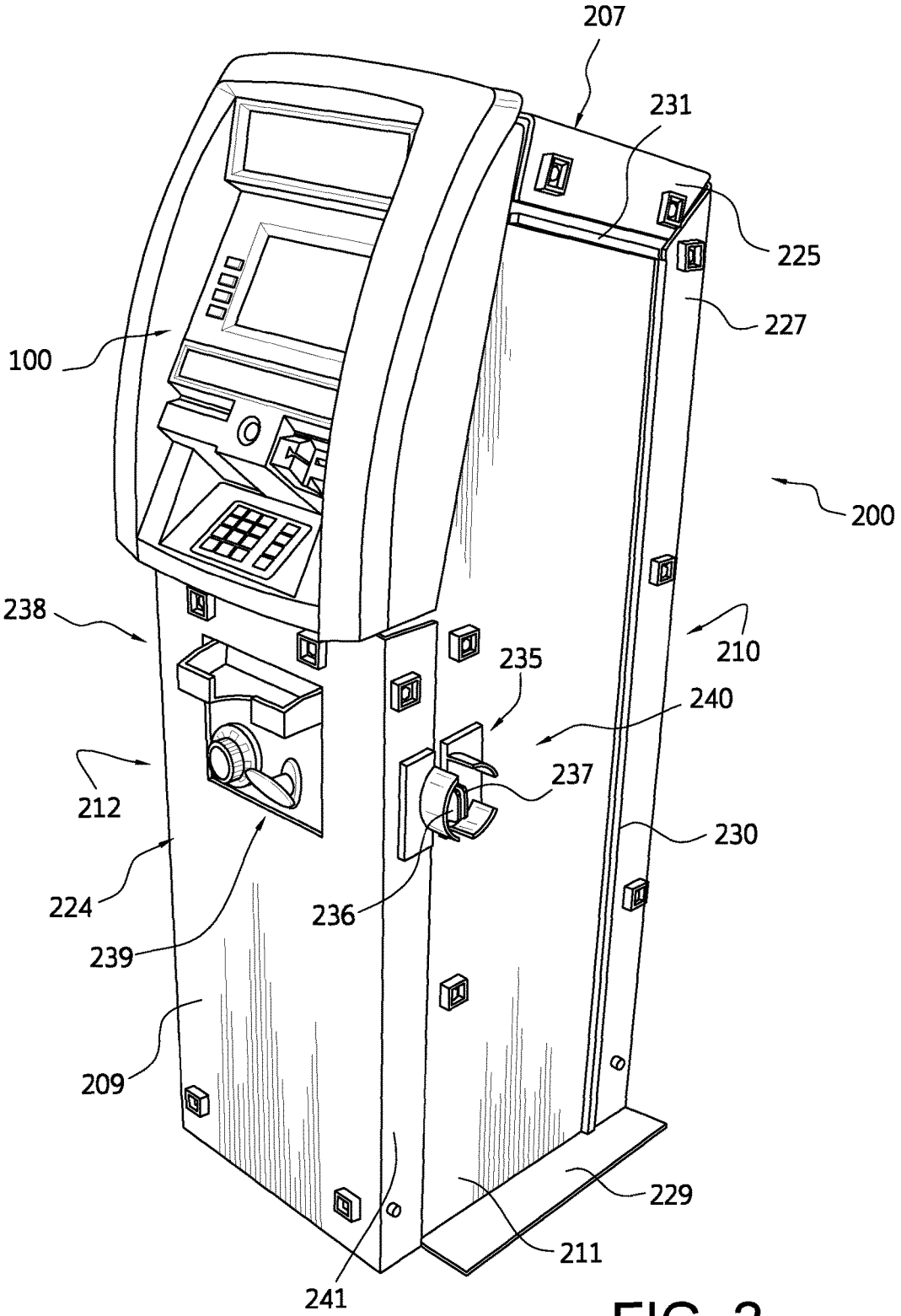
FIG. 2 illustrates a front, right side isometric view of a system enclosing the ATM of FIG. 1, according to an embodiment.
Figure 3:
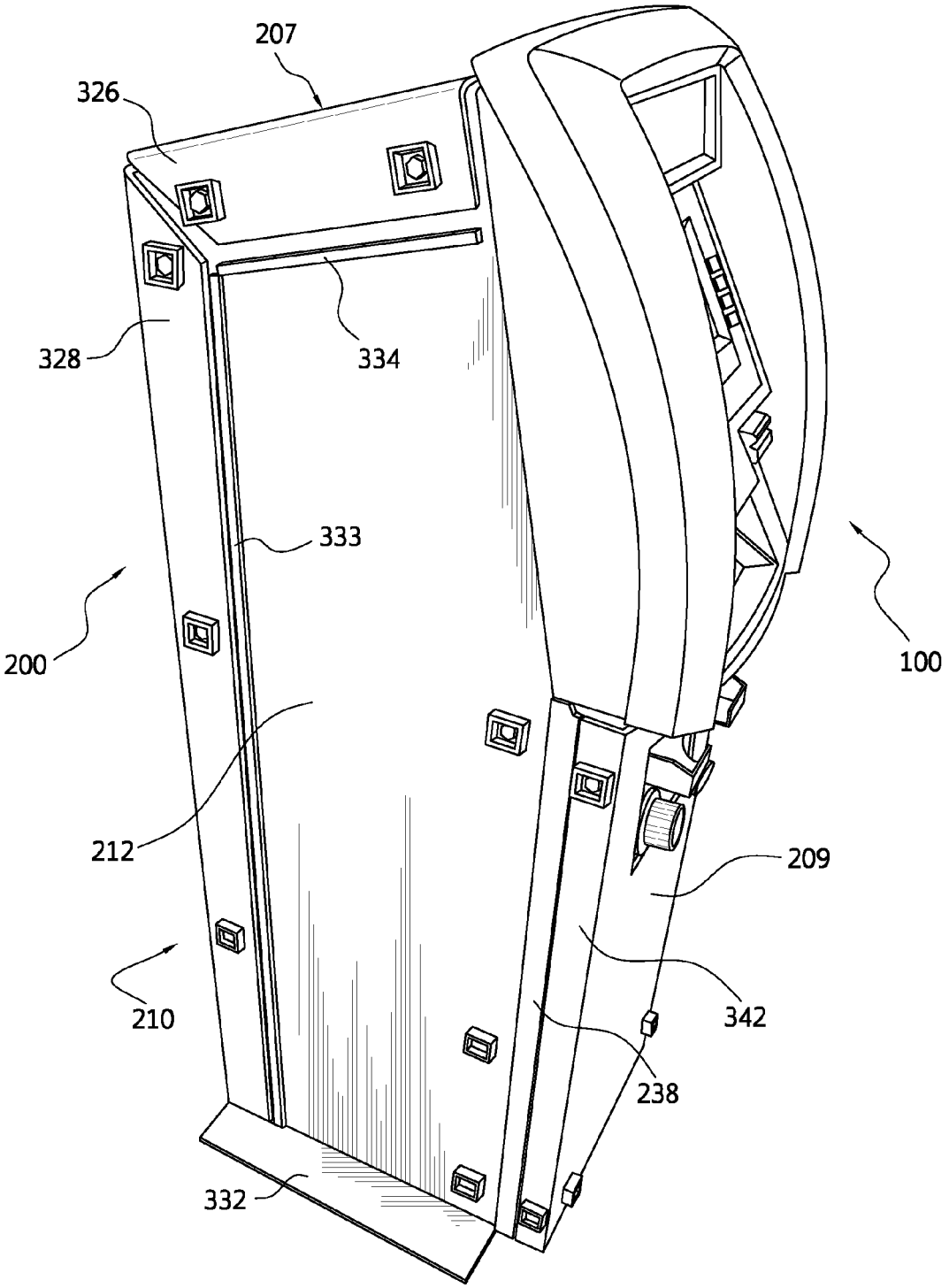
FIG. 3 illustrates a front, left side isometric view of the system enclosing the ATM of FIG. 1, according to the embodiment of FIG. 2.
Figure 4:
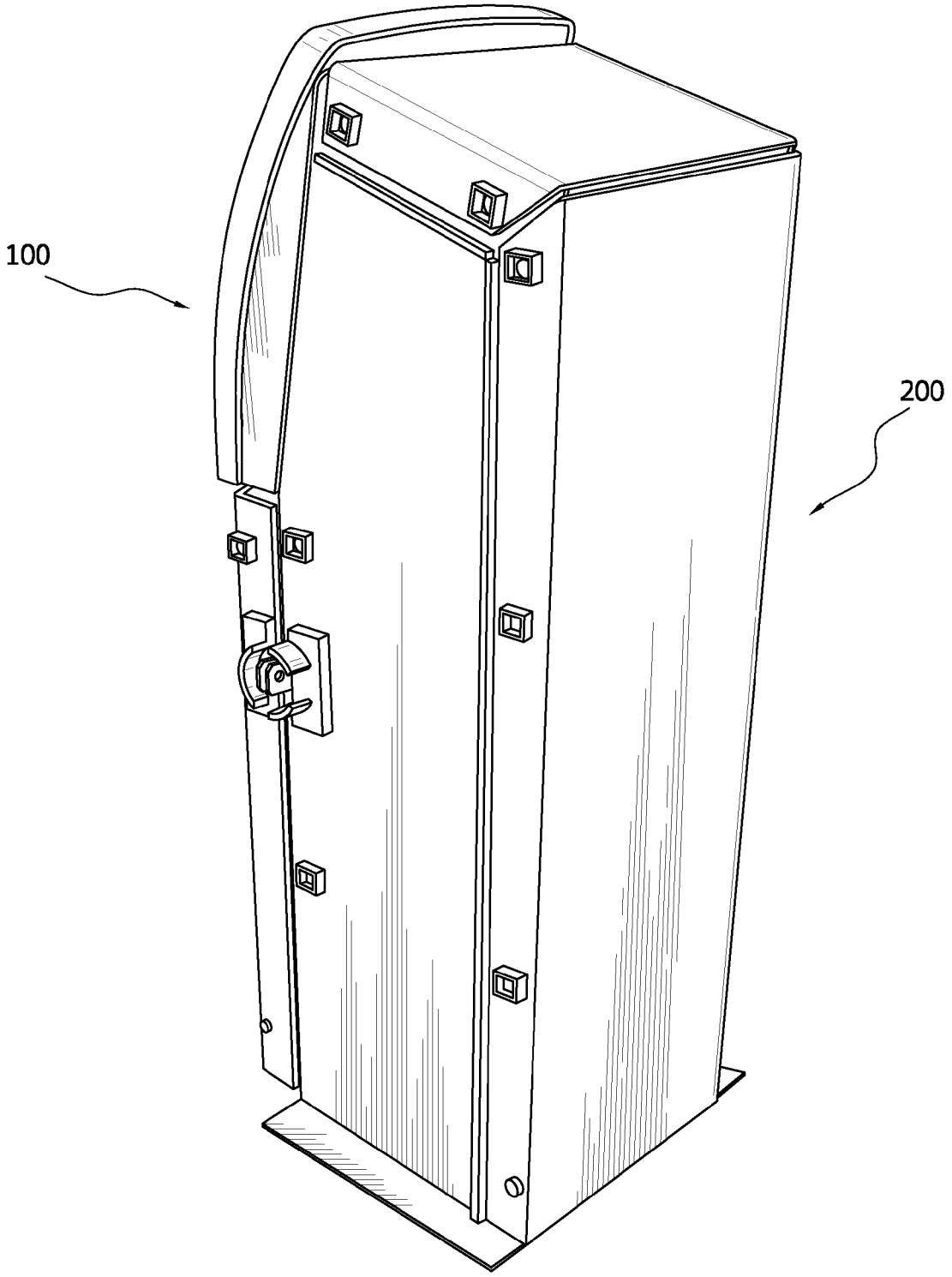
FIG. 4 illustrates a rear, top, right side isometric view of the system enclosing the ATM of FIG. 1, according to the embodiment of FIG. 2.
Figure 5:
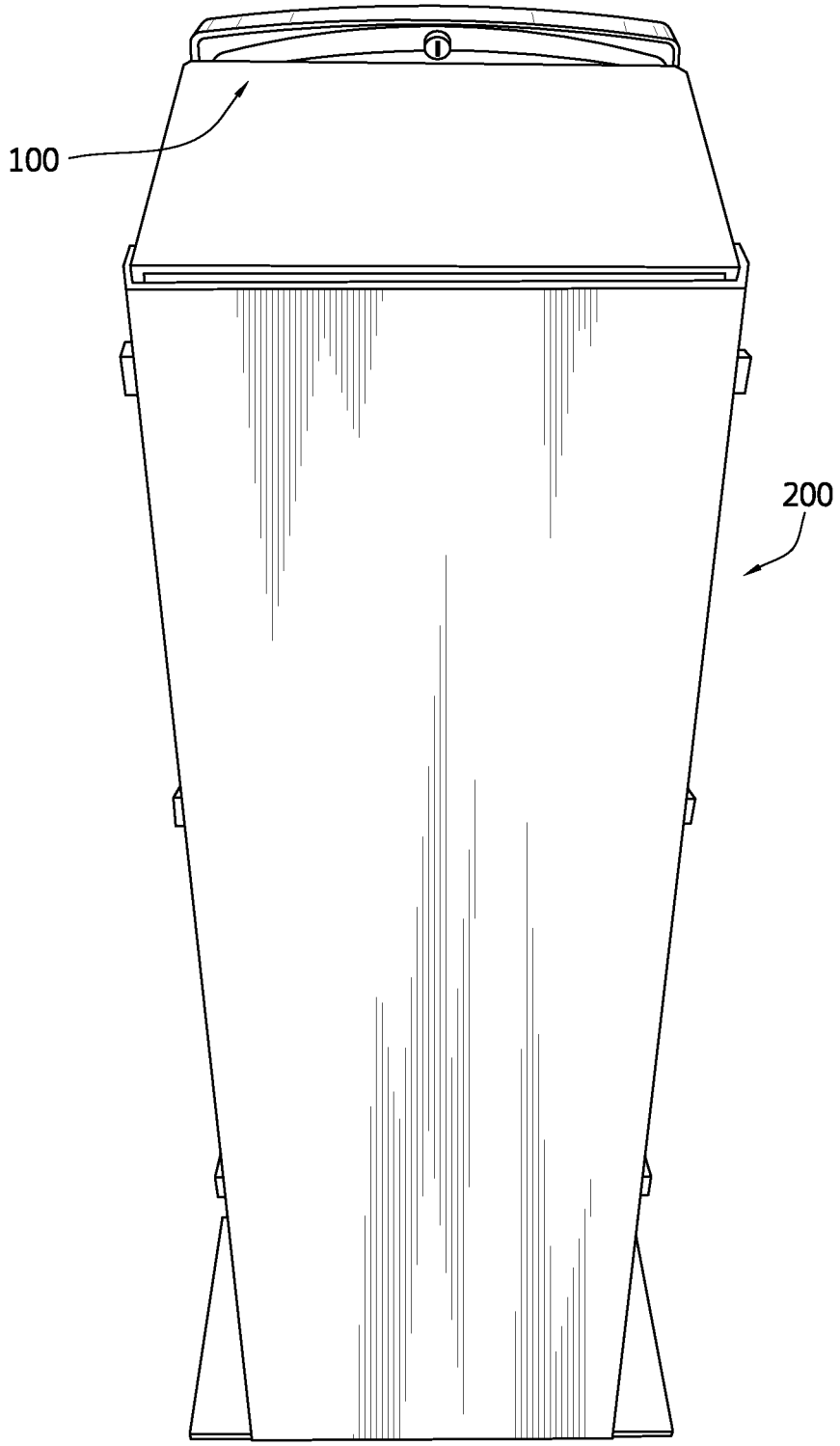
FIG. 5 illustrates a rear, top side isometric view of the system enclosing the ATM of FIG. 1, according to the embodiment of FIG. 2.

Turning to the next several drawings, FIGS. 2-5 illustrate various views of system 200 enclosing ATM 100 (FIG. 1), according to an embodiment. For example, FIG. 2 illustrates a front, right side isometric view of system 200, according to the embodiment; FIG. 3 illustrates a front, left side isometric view of system 200, according to the embodiment; FIG. 4 illustrates a rear, top, right side isometric view of system 200, according to the embodiment; and FIG. 5 illustrates a rear, top side isometric view of system 200, according to the embodiment. Nonetheless, system 200 is merely exemplary and is not limited to the embodiments presented herein. System 200 can be employed in many different embodiments or examples not specifically depicted or described herein.

Referring initially to FIG. 2, system 200 comprises jacket 224. Further, in many embodiments, jacket 224 can comprise one or more armor panels. For example, the armor panel(s) can comprise top armor panel (AP) 207, front AP 209, rear AP 210, right AP 211, and/or left AP 212. In some embodiments, when jacket 224 comprises multiple armor panels, one or more of the armor panel(s) can be implemented as discrete elements. Meanwhile, in these or other embodiments, two or more of the armor panel(s) can be implemented as one or more aggregate elements comprising multiple ones of the armor panel(s). When two or more of the armor panel(s) are implemented as an aggregate element, two or more of the armor panels can be manufactured together as a unitary (e.g., integral) element and/or two or more of the armor panels can be coupled (e.g., directly) together, such as, for example, by bonding (e.g., welding and/or adhering) those armor panel(s) together.

In some specific examples, each of top armor panel AP 207, front AP 209, rear AP 210, right AP 211, and/or left AP 212 can be implemented as discrete elements. In other specific examples, as illustrated and discussed in greater detail below with respect to FIGS. 21 & 22, two or more top armor panel AP 207, rear AP 210, right AP 211, and/or left AP 212 can be implemented as an aggregate element, and front AP 209 can be implemented as a discrete element, separate from the aggregate element of top armor panel AP 207, rear AP 210, right AP 211, and/or left AP 212.

Jacket 224 and/or the armor panel(s) (e.g., top armor panel AP 207, front AP 209, rear AP 210, right AP 211, and/or left AP 212) are configured to be coupled to an exterior surface (e.g., top SP 107 (FIG. 1), bottom SP 108 (FIG. 1), front SP 109 (FIG. 1), rear SP 110 (FIG. 1), right SP 111 (FIG. 1), and/or left SP 112 (FIG. 1)) of ATM 100 (FIG. 1). Further, one or more of the armor panel(s) (e.g., top armor panel AP 207, front AP 209, rear AP 210, right AP 211, and/or left AP 212) can be coupled to each other.

Accordingly, in many embodiments, jacket 224 and/or the armor panel(s) (e.g., top armor panel AP 207, front AP 209, rear AP 210, right AP 211, and/or left AP 212) can be configured to at least partially enclose, reinforce, and/or secure ATM 100 (FIG. 1) and/or vault 199. Jacket 224 and/or the armor panel(s) (e.g., top armor panel AP 207, front AP 209, rear AP 210, right AP 211, and/or left AP 212) can be coupled to ATM 100 (FIG. 1), and the armor panel(s) can be coupled to each other according to any suitable coupling technique(s), such as, for example, by mechanical coupling (e.g., by bolting and/or screwing) and/or by bonding (e.g., by welding and/or by adhering (e.g., by epoxy)) jacket 224 to ATM 100 (FIG. 1). In further embodiments, jacket 224 and/or the armor panel(s) (e.g., top armor panel AP 207, front AP 209, rear AP 210, right AP 211, and/or left AP 212) can be configured to substantially conform to a form factor of part or all of the exterior surface of ATM 100 (i.e., one or more of top SP 107, bottom SP 108, front SP 109, rear SP 110, right SP 111, and/or left SP 112) when coupled to ATM 100 (FIG. 1). That is, jacket 224 and/or the armor panel(s) (e.g., top armor panel AP 207, front AP 209, rear AP 210, right AP 211, and/or left AP 212) can be approximately flush with and/or contoured with part or all of one or more of top SP 107, bottom SP 108, front SP 109, rear SP 110, right SP 111, and/or left SP 112.

In many embodiments, jacket 224 and/or the armor panel(s) (e.g., top AP 207, front AP 209, rear AP 210, right AP 211, and/or left AP 212) can remain separate from ATM 100 (FIG. 1) (e.g., top SP 107, bottom SP 108, front SP 109, rear SP 110, right SP 111, and/or left SP 112) even though jacket 224 is coupled to ATM 100. In these embodiments, jacket 224 can be separable from ATM 100 (FIG. 1).

In general, system 200 and/or jacket 224 can be operable to prevent and/or deter (e.g., discourage) theft of currency from ATM 100 (FIG. 1). Further, system 200 and/or jacket 224 can provide an alternative to a "level one" vault for securing ATM 100 (FIG. 1). In many embodiments, system 200 and/or jacket 224 can weigh less, fill less volume, and/or cost less to manufacture than a "level one" vault. For example, system 200 and/or jacket 224 can be smaller in one or more cross sectional dimensions than a "level one" vault, such as, for example, by up to approximately 15.24 centimeters in a particular dimension.

In many embodiments, right AP 211 can comprise right foot 229, and/or left AP 212 can comprise left foot 332 (FIG. 3). In these or other embodiments, rear AP 210 can comprise a rear foot similar to right foot 229 and/or left foot 332 (FIG. 3). In other embodiments, right foot 229, left foot 332 (FIG. 3), and/or the rear foot can be omitted.

In further embodiments, top AP 207 can comprise top right wing 225 and top left wing 326 (FIG. 3) opposite top right wing 225; and/or rear AP 210 can comprise rear right wing 227 and rear left wing 328 (FIG. 3) opposite rear right wing 227. Meanwhile, right AP 211 can comprise rear right trim extension 230 and/or top right trim extension 231; and/or left AP 212 can comprise rear left trim extension 333 (FIG. 3) and/or top left trim extension 334 (FIG. 3). In other embodiments, top right wing 225, top left wing 326 (FIG. 3), rear right wing 227, rear left wing 328 (FIG. 3), rear right trim extension 230, top right trim extension 231, rear left trim extension 333 (FIG. 3), and/or top left trim extension 334 (FIG. 3). For example, in some embodiments, when two or more of the armor panels are implemented as aggregate elements, one or more of top right wing 225, top left wing 326 (FIG. 3), rear right wing 227, rear left wing 328 (FIG. 3), rear right trim extension 230, top right trim extension 231, rear left trim extension 333 (FIG. 3), and/or top left trim extension 334 (FIG. 3) can be omitted.

In these or other embodiments, front AP 209 can comprise front right wing 241 and front left wing 342 (FIG. 3). In other embodiments, front right wing 241 and/or front left wing 342 (FIG. 3) can be omitted.

Meanwhile, jacket 224 can comprise one or more engagement mechanism(s) 240 (e.g., first engagement mechanism 235). Each of engagement mechanism(s) 240 (e.g., first engagement mechanism 235) can be configured to engage with a respective jacket locking mechanism. For example, first engagement mechanism 235 can be configured to engage with a first jacket locking mechanism. In some embodiments, system 200 and/or jacket 224 can comprise the jacket locking mechanism(s). The jacket locking mechanism(s) can comprise any suitable type of locking mechanism (e.g., one or more puck locks, one or more pad locks, one or more combination locks, etc.). In various embodiments, first engagement mechanism 235 can comprise front engagement feature 236 and side engagement feature 237, which can be coupled together with a first jacket locking mechanism (e.g., a puck lock). The functionality of engagement mechanism(s) 240 and the jacket locking mechanism(s) are described in further detail below with respect to front AP 209.

In many embodiments, one or more of engagement mechanism(s) 240 can be implemented as a unitary part of jacket 224. In these or other embodiments, one or more of engagement mechanisms 240 can be coupled to jacket 224. For example, first engagement mechanism 235, front engagement feature 236, and/or side engagement feature 237 can be coupled to jacket 224, such as, for example, by bonding (e.g., welding) first engagement mechanism 235, front engagement feature 236, and/or side engagement feature 237 to jacket 224.

Further, jacket 224 and/or front AP 209 can comprise hinge mechanism 238. Hinge mechanism 238 can be part of one of front right wing 241 or front left wing 342 (FIG. 3). Also, front AP 209 can comprise one or more apertures 239. For example, aperture(s) 239 comprise a first aperture. Further, in some embodiments, aperture(s) 239 also can comprise a second aperture. In other embodiments, hinge mechanism 238 and/or aperture(s) 239 can be omitted.

In some embodiments, in operation, top AP 207 can be coupled (e.g., mechanically and/or by bonding) to top SP 107 (FIG. 1), right AP 211, left AP 212, right SP 111 (FIG. 1), and/or left SP 112 (FIG. 1); front AP 209 can be coupled (e.g., mechanically and/or by bonding) to front SP 109 (FIG. 1) and/or one of (i) right AP 211 and/or right SP 111 (FIG. 1) or (ii) left AP 212 and/or left SP 112 (FIG. 1); rear AP 210 can be coupled (e.g., mechanically and/or by bonding) to rear SP 110 (FIG. 1), right AP 211, left AP 212, right SP 111 (FIG. 1), and/or left SP 112 (FIG. 1); right AP 211 can be coupled (e.g., mechanically and/or by bonding) to right SP 111 (FIG. 1), and/or left AP 212 can be coupled (e.g., mechanically and/or by bonding) to left SP 112 (FIG. 1).

In some embodiments, when top AP 207, front AP 209, rear AP 210, right AP 211, and/or left AP 212 are bonded (e.g., welded and/or adhered) to top SP 107 (FIG. 1), front SP 109 (FIG. 1), rear SP 110 (FIG. 1), right SP 111 (FIG. 1), and/or left SP 112 (FIG. 1), then top right wing 225, top left wing 326 (FIG. 3), rear right wing 227, rear left wing 328 (FIG. 3), rear right trim extension 230, top right trim extension 231, rear left trim extension 333 (FIG. 3), and/or top left trim extension 334 (FIG. 3) can be omitted.

In some embodiments, top right wing 225 and/or top left wing 326 (FIG. 3) can extend from and/or can be approximately perpendicular to part (e.g., a central part) of top AP 207; and/or rear right wing 227 and/or rear left wing 328 can extend from and/or can be approximately perpendicular to part (e.g., a central part) of rear AP 210. In various embodiments, when right AP 211 is coupled to right SP 111 (FIG. 1), top right wing 225 can be configured to partially overlap right SP 111 at and/or proximate to top SP right edge 113 (FIG. 1), and/or rear right wing 227 can be configured to partially overlap right SP 111 at and/or proximate to rear SP right edge 115 (FIG. 1); further, when left AP 212 is coupled to left SP 112 (FIG. 1), top left wing 326 can be configured to partially overlap left SP 112 at and/or proximate to top SP left edge 114 (FIG. 1), and/or rear left wing 328 can be configured to partially overlap left SP 112 at and/or proximate to rear SP left edge 116 (FIG. 1). In these embodiments, top right wing 225 can be coupled to right AP 211 and right SP 111 at and/or proximate to top SP right edge 113 (FIG. 1); rear right wing 227 can be coupled to right AP 211 and right SP 111 at and/or proximate to rear SP right edge 115 (FIG. 1); top left wing 326 can be coupled to left AP 212 and left SP 112 at and/or proximate to top SP left edge 114 (FIG. 1); and/or rear left wing 328 can be coupled to left AP 212 and left SP 112 at and/or proximate to rear SP left edge 116 (FIG. 1).

In some embodiments, front right wing 241 and/or front left wing 342 (FIG. 3) can extend from and/or can be approximately perpendicular to part (e.g., a central part) of front AP 209. Front right wing 241 can extend from the part of front AP 209 toward right AP 211 when right AP 211 is coupled to right SP 111 (FIG. 1), and front left wing 342 (FIG. 3) can extend from the part of front AP 209 toward left AP 212 when left AP 212 is coupled to left SP 112. In other embodiments, front right wing 241 and/or front left wing 342 (FIG. 3) can be omitted.

In some embodiments, right foot 229 can extend from and/or can be approximately perpendicular with right AP 211; and/or left foot 332 (FIG. 3) can extend from and/or can be approximately perpendicular with left AP 212. In various embodiments, when right AP 211 is coupled to right SP 111 (FIG. 1), right foot 229 can extend from right AP 211 at right SP bottom edge 117 (e.g., toward and/or away from right SP 111), and/or when left AP 212 is coupled to left SP 112 (FIG. 1), left foot 332 (FIG. 3) can extend from left AP 212 at left SP bottom edge 119 (e.g., toward and/or away from left SP 112). Further, when rear AP 210 comprises a rear foot and when rear AP 210 is coupled to rear SP 110, the rear foot can extend from rear AP 210 at a rear SP bottom edge (e.g., toward and/or away from rear SP 110).

Right foot 229, left foot 332, and/or the rear foot can be coupled (e.g., mechanically and/or by bonding) to another surface (e.g., the ground) to anchor jacket 224, and thereby anchor ATM 100 (FIG. 1), to the other surface. For example, in many embodiments, right foot 229 and left foot 332 (FIG. 3) can be coupled to the other surface with any suitable anchor screws and/or bolts. The anchor bolts can be greater than or equal to approximately 0.635 centimeters and less than or equal to approximately 2.540 centimeters in diameter. In further embodiments, the anchor bolts can be greater than or equal to approximately 1.270 centimeters and less than or equal to 1.588 centimeters in diameter. The anchor bolts can be greater than or equal to approximately 11.43 centimeters and less than or equal to approximately 15.24 centimeters in length. Exemplary anchor screws can comprise lag screws (e.g., for wood surfaces) and/or cap screws with nuts (e.g., for surfaces having accessible undersides).

In many embodiments, like front SP 109, front AP 209 can be implemented as a door to provide access to at least part of vault 199 of ATM 100. For example, when front AP 209 is coupled to front SP 109, front AP 209 can be coupled (e.g., via hinge mechanism 238) to one of right AP 211 or left AP 212. In other examples, when front AP 209 is coupled to front SP 109, front AP 209 can be coupled (e.g., via the hinge of front SP 109) to one of right SP 111 or left SP 112. In either of these or other embodiments, front AP 209 can be movable with front SP 109 between the open position (i.e., providing access to vault 199 of ATM 100 (FIG. 1) at front side 103 (FIG. 1)) and the closed position (i.e., preventing access to vault 199 of ATM 100). Further, when front AP 209 is coupled to front SP 109, aperture(s) 239 can provide access to ATM locking mechanism(s) 123 (FIG. 1), the handle, and/or the dispensing aperture of front SP 109 (FIG. 1). Front AP 209 can be configured so that the shield of front SP 109 (FIG. 1) can be coupled to front AP 209 (and/or removed from front SP 109) to perform similar functionality at front AP 209 to that described above with respect to front SP 109. In other embodiments, a different shield can be used as opposed to the shield of front SP 109 (FIG. 1). The different shield can be similar to the shield of front SP 109 (FIG. 1).

As mentioned previously, jacket 224 can comprise first engagement mechanism 235. Further, front engagement feature 236 can be located at front AP 209 (e.g., at front right wing 241, at front left wing 342 (FIG. 3), and/or proximate to side engagement feature 237), and/or side engagement feature 237 can be located at one of right AP 211 or left AP 212, such as, for example, opposite hinge mechanism 238. The first jacket locking mechanism can couple front engagement feature 236 to side engagement feature 237. In turn, when the first jacket locking mechanism couples front engagement feature 236 to side engagement feature 237, the first jacket locking mechanism can maintain front AP 209 and/or front SP 109 (FIG. 1) in the closed position, preventing front AP 209 and/or front SP 109 (FIG. 1) from being moved from the closed position to the open position. The jacket locking mechanism(s) can be configured so that only authorized personnel can readily and/or legally disengage the jacket locking mechanism(s) in order to access the vault via front AP 209 and/or front SP 109 (FIG. 1).

In some embodiments, the first aperture of aperture(s) 239 can be approximately centered at front AP 209 between right AP 211 and left AP 212. Meanwhile, the second aperture of aperture(s) 239 can be closer to right AP 211 than to left AP 212, or vice versa. In many embodiments, the first aperture of aperture(s) 239 can be aligned with the dispensing aperture of front SP 109 (FIG. 1) and the second aperture of aperture(s) 239 can be aligned with the handle of front SP 109.

Top SP 107, front SP 109, rear SP 110, right SP 111, and/or left SP 112 can comprise one or more SP apertures, and top AP 207, front AP 209, rear AP 210, right AP 211, and/or left AP 212 can comprise one or more AP apertures corresponding to the SP aperture(s). The AP aperture(s) and SP aperture(s) can be configured to permit top AP 207, front AP 209, rear AP 210, right AP 211, and/or left AP 212 to be mechanically coupled (e.g., by bolting and/or screwing) to top SP 107, front SP 109, rear SP 110, right SP 111, and/or left SP 112, as applicable. In other embodiments, the SP aperture(s) and/or AP aperture(s) can be omitted.

The SP apertures and/or AP apertures can be cut in the side panel(s) of ATM 100 (FIG. 1) and/or the armor panel(s) of jacket 224 (FIGS. 2-5), respectively, using a mechanical drill and/or a laser drill. Accurately placing the locations of SP apertures and/or AP apertures at the side panel(s) of ATM 100 (FIG. 1) and/or the armor panel(s) of jacket 224 (FIGS. 2-5), respectively, can be accomplished by using a drill template (e.g., clamped to the side panel(s) and/or armor panel(s)).

Where applicable, same or different types and sizes of bolts can be implemented to bolt together jacket 224 and ATM 100 (FIG. 1). For example, the bolts can be greater than or equal to approximately 0.950 centimeters and less than or equal to approximately 2.54 centimeters in diameter. Meanwhile, the SP aperture(s) and/or AP aperture(s) can correspond in size to the sizes of the respective bolts. For example, the SP aperture(s) and/or AP aperture(s) can each comprise a diameter of 1.43 centimeters.

Top right trim extension 231 can be configured to approximately abut top right wing 225, such as, for example, when top AP 207 is located at top SP 107 (FIG. 1); top left trim extension 334 (FIG. 3) can be configured to approximately abut top left wing 326 (FIG. 3) such as, for example, when top AP 207 is located at top SP 107 (FIG. 1); rear right trim extension 230 can be configured to approximately abut rear right wing 227, such as, for example, when rear AP 210 is located at rear SP 110 (FIG. 1); and/or rear left trim extension 333 (FIG. 3) can be configured to approximately abut rear left wing 328 (FIG. 3), such as, for example, when rear AP 210 is located at rear SP 110 (FIG. 1). Accordingly, rear right trim extension 230, top right trim extension 231, rear left trim extension 333 (FIG. 3), and/or top left trim extension 334 (FIG. 3) can be configured to prevent and/or make more difficult the cutting of one or more bolts coupling jacket 224 to ATM 100 (FIG. 1). Rear right trim extension 230 and/or top right trim extension 231 can be welded to right AP 211, and/or rear left trim extension 333 (FIG. 3) and/or top left trim extension 334 (FIG. 3) can be welded to left AP 212.

Likewise, engagement mechanism(s) 240 (e.g., first engagement mechanism 235) and/or one or more of the AP apertures can be shrouded by one or more shrouds of jacket 224 and/or the armor panel(s) of jacket 224 to prevent and/or make more difficult the cutting of one or more bolts and/or screws coupling jacket 224 to ATM 100 (FIG. 1). For example, the shroud(s) can at least partially enclose engagement mechanism(s) 240 (e.g., first engagement mechanism 235) and/or the one or more of the AP apertures, such as, for example, by projecting outward from jacket 224 and/or around (e.g., partially or fully circumscribing) engagement mechanism(s) 240 (e.g., first engagement mechanism 235) and/or the one or more of the AP apertures.

Shroud(s) for engagement mechanism(s) 240 (e.g., first engagement mechanism 235) can be implemented by forming each of the shroud(s) from an aggregation of smaller (e.g., planar) metal panels bonded together (e.g., by welding) to form one or more desired shapes (e.g., two curved (e.g., approximately semicircular) shapes) sized according to engagement mechanism(s) 240 (e.g., first engagement mechanism 235) and/or the jacket locking mechanism(s) (e.g., first jacket locking mechanism). These aggregate elements of the shroud(s) can then be bonded (e.g., by welding) to jacket 224 and/or the armor panel(s) of jacket 224 about engagement mechanism(s) 240 (e.g., first engagement mechanism 235).

Further, in some embodiments, shroud(s) for the AP apertures can be implemented by machining (e.g., laser drilling) a desired shape (e.g., a shape of a bolt head) from a unitary body and bonding the remaining element about (e.g., around) the respective ones of the AP apertures. Notably, in some embodiments, the manner of implementing shroud(s) for engagement mechanism(s) 240 (e.g., first engagement mechanism 235) may be used for shroud(s) for the AP apertures, and vice versa.

Jacket 224 and/or the armor panel(s) of jacket 224 (e.g., top AP 207, front AP 209, rear AP 210, right AP 211, and/or left AP 212) can comprise any suitable materials (e.g., steel, stainless steel, aluminum, hardened glass (e.g., alkali-aluminosilicate), hardened plastic (e.g., polycarbonate), etc.). In many embodiments, the material can be as hard or harder than a material of top SP 107, bottom SP 108, front SP 109, rear SP 110, right SP 111, and/or left SP 112 of ATM 100 in FIG. 1. Further, top AP 207, front AP 209, rear AP 210, right AP 211, and/or left AP 212 can comprise any suitable thickness. For example, one or more of top AP 207, front AP 209, rear AP 210, right AP 211, and/or left AP 212 can comprise a thickness greater than or equal to approximately 0.470 centimeters and less than or equal to approximately 2.54 centimeters. In some embodiments, the thickness can comprise approximately 0.476 centimeters, approximately 0.478 centimeters, or approximately 0.635 centimeters.

In some embodiments, system 200 can comprise a global positioning system module to track the location of system 200, jacket 224, and/or ATM 100 (FIG. 1).

Turning ahead in the drawings, FIG. 6 illustrates system 200 enclosing ATM 100 when front SP 109 and front AP 209 are in the open position, according to the embodiment of FIGS. 2-5. As illustrated, currency dispensing mechanism 622 and user interface 211 (FIG. 2) are exposed and retracted from within vault 199 of ATM 100 (FIG. 1).

Figure 21:
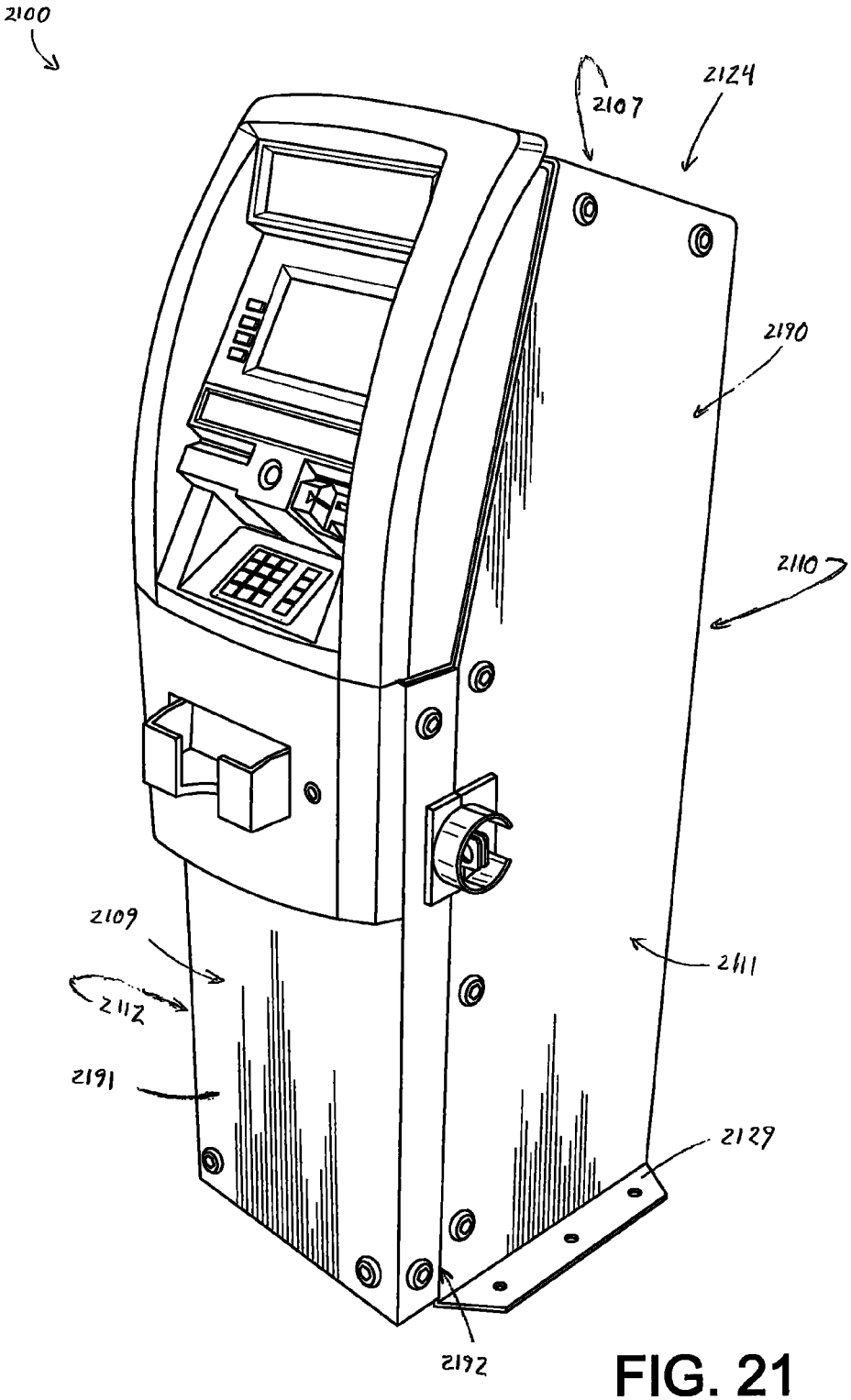
FIG. 21 illustrates a front, right side isometric view of a system, according to an embodiment.
Figure 22:
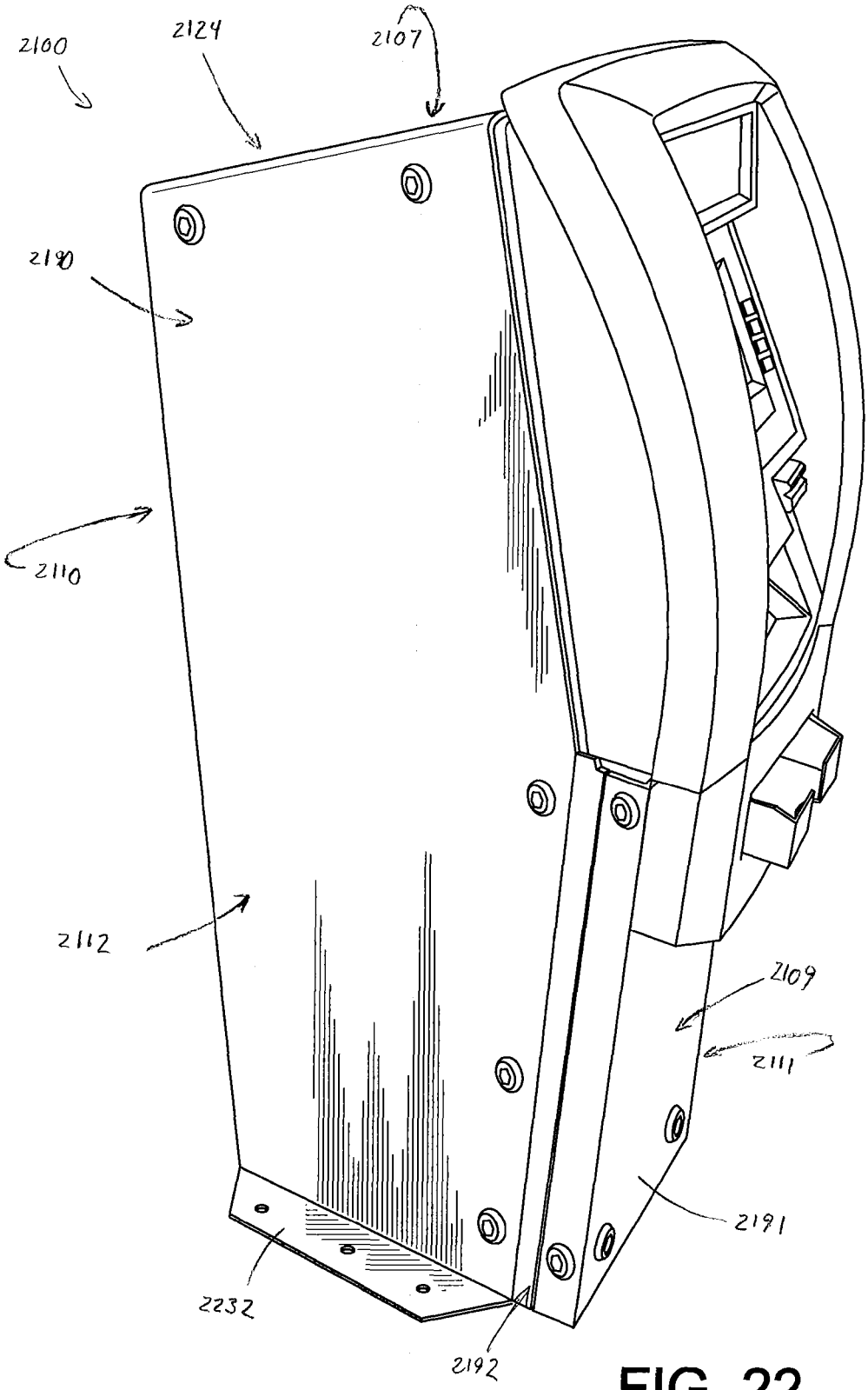
FIG. 22 illustrates a front, left side isometric view of the system, according to the embodiment of FIG. 21.

Turning ahead in the drawings again, FIGS. 21 & 22 illustrate various views of system 2100 enclosing ATM 100 (FIG. 1), according to an embodiment. For example, FIG. 21 illustrates a front, right side isometric view of system 2100, according to the embodiment; and FIG. 22 illustrates a front, left side isometric view of system 2100, according to the embodiment. System 2100 is merely exemplary and is not limited to the embodiments presented herein. System 2100 can be employed in many different embodiments or examples not specifically depicted or described herein.

In many embodiments, system 2100 can be similar or identical to system 200 (FIGS. 2-6). Accordingly, in these or other embodiments, system 2100 comprises jacket 2124. Jacket 2124 can be similar or identical to jacket 224 (FIG. 2).

Further, in many embodiments, jacket 2124 can comprise one or more armor panels 2192. Armor panel(s) 2192 can be similar or identical to the armor panel(s) described above with respect to system 200 (FIGS. 2-6). For example, armor panel(s) 2192 of system 2100 can comprise top AP 2107, front AP 2109, rear AP 2110, right AP 2111, and/or left AP 2112. Meanwhile, top AP 2107 can be similar or identical to top AP 207 (FIG. 2); front AP 2109 can be similar or identical to front AP 209 (FIG. 2); rear AP 2110 can be similar or identical to rear AP 210 (FIG. 2); right AP 2111 can be similar or identical to right AP 211 (FIG. 2); and/or left AP 2112 can be similar or identical to left AP 212 (FIG. 2).

Top AP 2107, rear AP 2110, right AP 2111, and left AP 2112 are implemented as aggregate element 2190, and front AP 209 is implemented as discrete element 2191, separate from aggregate element 2190. Aggregate element 2190 can be similar or identical to the aggregate element(s) described above with respect to system 200 (FIGS. 2-6), and discrete element 2191 can be similar or identical to the discrete element(s) described above with respect to system 200 (FIGS. 2-6).

In these embodiments, rear AP 2110, right AP 2111, and left AP 2112 can be implemented as an integral or unitary aggregate element, and top AP 2107 can be bonded (e.g., by welding) to rear AP 2110, right AP 2111, and/or left AP 2112 (e.g., proximate to top side 101 when system 2100 is coupled the exterior surface of ATM 100 (FIG. 1)) to provide aggregate element 2190.

In many embodiments, top AP 2107, rear AP 2110, right AP 2111, and left AP 2112 do not overlap with each other. Further, right AP 2111 and/or left AP 2112 can extend from and/or perpendicular to rear AP 2110. For example, in some embodiments, right AP 2111 and/or left AP 2112 can be folded from being planar with rear AP 2110 to the perpendicular positions during manufacturing. Therefore, in these embodiments, right AP 2111, left AP 2112, and rear AP 2110 are made from the same integral piece of material and are not separated from each other during the manufacturing or assembly process for jacket 2124. After right AP 2111 and left AP 2112 are bent to the appropriate angle(s), top AP 2107 can be bonded (e.g., by welding) to rear AP 2110, right AP 2111, and left AP 2112 simultaneously or in any suitable order.

Jacket 2124, armor panel(s) 2192 (e.g., top armor panel AP 2107, front AP 2109, rear AP 2110, right AP 2111, and/or left AP 2112), aggregate element 2190, and/or discrete element 2191 are configured to be coupled to the exterior surface (e.g., top SP 107 (FIG. 1), bottom SP 108 (FIG. 1), front SP 109 (FIG. 1), rear SP 110 (FIG. 1), right SP 111 (FIG. 1), and/or left SP 112 (FIG. 1)) of ATM 100 (FIG. 1).

Accordingly, in many embodiments, jacket 2124, armor panel(s) 2192 (e.g., top armor panel AP 2107, front AP 2109, rear AP 2110, right AP 2111, and/or left AP 2112), aggregate element 2190, and/or discrete element 2191 can be configured to at least partially enclose, reinforce, and/or secure ATM 100 (FIG. 1) and/or vault 199 (FIG. 1). Jacket 2124, armor panel(s) 2192 (e.g., top armor panel AP 2107, front AP 2109, rear AP 2110, right AP 2111, and/or left AP 2112), aggregate element 2190, and/or discrete element 2191 can be coupled to ATM 100 (FIG. 1) according to any suitable coupling technique(s), such as, for example, by mechanical coupling (e.g., by bolting and/or screwing) and/or by bonding (e.g., by welding and/or by adhering (e.g., by epoxy)) jacket 2124 to ATM 100 (FIG. 1). In further embodiments, jacket 2124, armor panel(s) 2192 (e.g., top armor panel AP 2107, front AP 2109, rear AP 2110, right AP 2111, and/or left AP 2112), aggregate element 2190, and/or discrete element 2191 can be configured to substantially conform to a form factor of part or all of the exterior surface of ATM 100 (i.e., one or more of top SP 107, bottom SP 108, front SP 109, rear SP 110, right SP 111, and/or left SP 112) when coupled to ATM 100 (FIG. 1). That is, jacket 2124, armor panel(s) 2192 (e.g., top armor panel AP 2107, front AP 2109, rear AP 2110, right AP 2111, and/or left AP 2112), aggregate element 2190, and/or discrete element 2191 can be approximately flush with and/or contoured with part or all of one or more of top SP 107, bottom SP 108, front SP 109, rear SP 110, right SP 111, and/or left SP 112.

In general, system 2100 and/or jacket 2124 can be operable to prevent and/or deter (e.g., discourage) theft of currency from ATM 100 (FIG. 1). Further, system 2100 and/or jacket 2124 can provide an alternative to a "level one" vault for securing ATM 100 (FIG. 1). In many embodiments, system 2100 and/or jacket 2124 can weigh less, fill less volume, and/or cost less to manufacture than a "level one" vault. For example, system 2100 and/or jacket 2124 can be smaller in one or more cross sectional dimensions than a "level one" vault, such as, for example, by up to approximately 15.24 centimeters in a particular dimension.

In many embodiments, right AP 2111 can comprise right foot 2129, and/or left AP 2112 can comprise left foot 2232 (FIG. 22). In these or other embodiments, rear AP 2110 can comprise a rear foot similar to right foot 2129 and/or left foot 2232 (FIG. 22). In other embodiments, right foot 2129, left foot 2232 (FIG. 22), and/or the rear foot can be omitted. Right foot 2129 can be similar or identical to right foot 229, left foot 2232 can be similar or identical to left foot 332 (FIG. 3), and/or the rear foot can be similar or identical to the rear foot described above with respect to system 200 (FIGS. 2-6).

Turning back now in the drawings, FIGS. 7-10 illustrate two dimensional wire frame schematics of various exemplary elements of system 700, according to an embodiment. System 700 can be similar or identical to system 200 (FIGS. 2-6) and/or system 2100 (FIGS. 21 & 22), and one or more elements of system 700 can be similar or identical to one or more elements of system 200 (FIGS. 2-6) and/or system 2100 (FIGS. 21 & 22). The examples shown at FIGS. 7-10 are merely for illustrative purposes to aid the reader with implementing system 700. In particular, the examples shown at FIGS. 7-10 provide one or more suggested dimensions of the elements of system 200 (FIGS. 2-6). Nonetheless, it should be appreciated that dimensionality of system 200 (FIGS. 2-6) and/or system 2100 (FIGS. 21 & 22) can depend on the dimensions of the particular ATM (e.g., ATM 100 (FIG. 1)) with which system 200 and/or system 2100 is implemented. Accordingly, in other embodiments, system 200 (FIGS. 2-6) and/or system 2100 (FIGS. 21 & 22) can be implemented using one or more other dimensions.

Meanwhile, because FIGS. 7-10 are provided as two dimensional wire frame schematics, numerous elements of FIGS. 7-10 are referenced as creases. Creases refer to axes about which two elements of FIGS. 7-10 form an angle. The creases are described herein because the angles may not be readily apparent by reference to FIGS. 7-10 alone. Further, in some embodiments, one or more of the elements of system 700 can comprise one or more holes. The holes can be implemented to mechanically couple (e.g., by bolting and/or screwing) one or more elements of system 700 to one or more other elements of system 700 and/or to an ATM. The ATM can be similar or identical ATM 100 (FIG. 1). Meanwhile, the holes can be similar or identical to the AP apertures described above with respect to system 200 (FIGS. 2-6).

Figure 7:
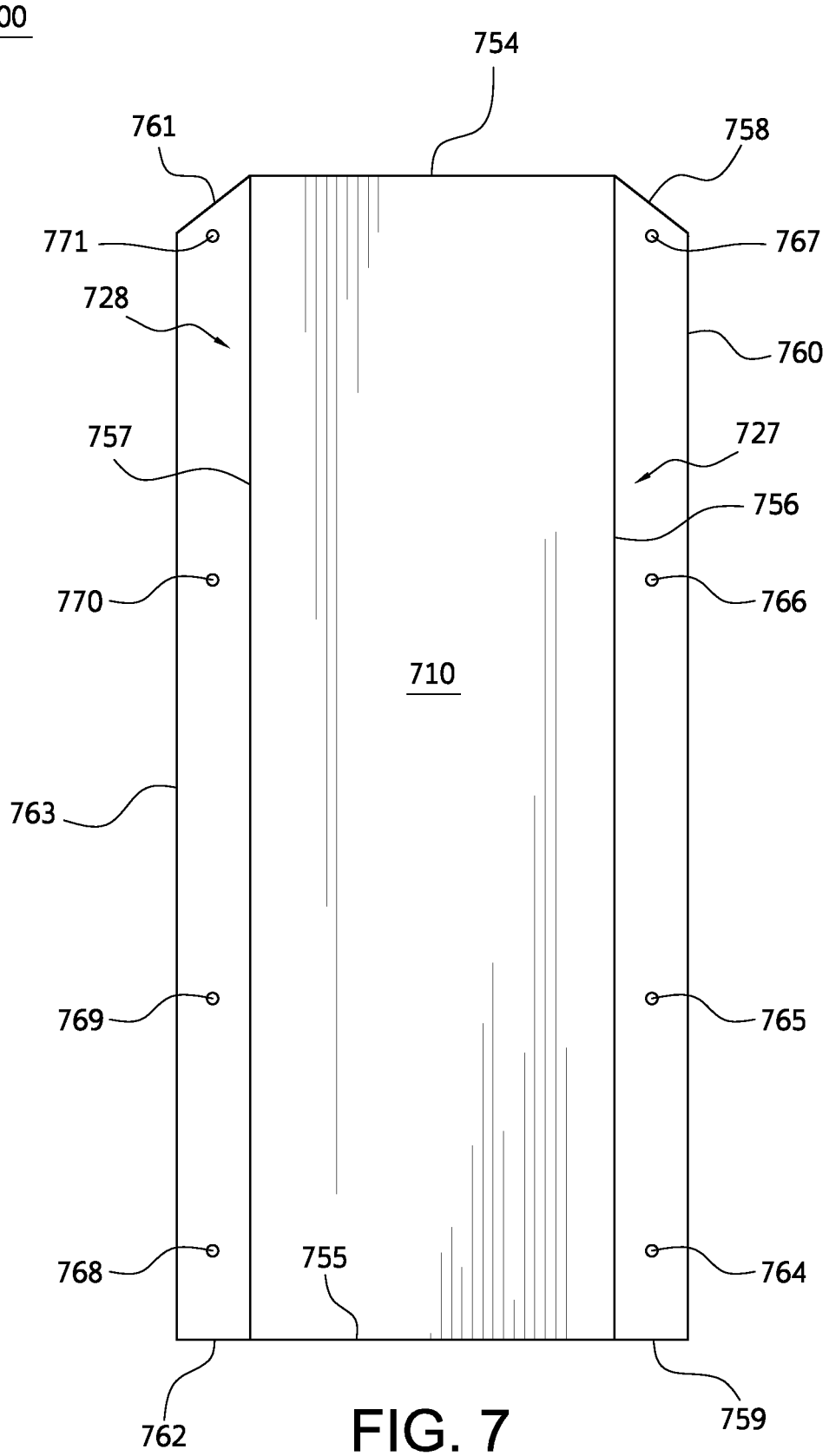
FIG. 7 illustrates a two dimensional schematic of an exemplary rear AP, rear right wing, and rear left wing of a system, according to an embodiment.

Referring first to FIG. 7 of the drawings, FIG. 7 illustrates a two dimensional schematic of exemplary rear AP 710, rear right wing 727, and rear left wing 728 of system 700, according to an embodiment. In many embodiments, rear AP 710 can be similar or identical to rear AP 210 (FIG. 2); rear right wing 727 can be similar or identical to rear right wing 227 (FIG. 2); and/or rear left wing 728 can be similar or identical to rear left wing 328 (FIG. 3). Further, in other embodiments, rear AP 710 can be similar or identical to rear AP 2110 (FIGS. 21 & 22).

Rear AP 710 can comprise top side 754, bottom side 755, right crease 756, and left crease 757. Further, rear right wing 727 can comprise top side 758, bottom side 759, right side 760, and right crease 756; and rear left wing 728 can comprise top side 761, bottom side 762, left side 763, and left crease 757.

Also, rear AP 710, rear right wing 727, and/or rear left wing 728 can comprise holes 764-771. In some embodiments, rear right wing 727 comprises holes 764-767, and rear left wing 728 comprises holes 768-771.

Top side 754 can be approximately parallel with bottom side 755, and approximately perpendicular with right crease 756 and left crease 757. Right crease 756 can be approximately parallel with right side 760 and approximately perpendicular with bottom side 759. Further, right crease 756 can form a 45 degree angle with top side 758. Meanwhile, left crease 757 can be approximately parallel with left side 763 and approximately perpendicular with bottom side 762. Further, left crease 757 can form a 45 degree angle with top side 754.

Further, in some embodiments, holes 764-767 can be arranged to form a straight line at rear right wing 727 that is approximately perpendicular to bottom side 759, and/or holes 764-767 can be arranged to form a straight line at rear left wing 728 that is approximately perpendicular to bottom side 762. Meanwhile, rear AP 710 can be approximately perpendicular to rear right wing 727 at right crease 756 and approximately perpendicular to rear left wing 728 at left crease 757.

In many embodiments, top side 754 and bottom side 755 each can comprise a length of approximately 40.32 centimeters; right crease 756 and left crease 757 each can comprise a length of approximately 133.69 centimeters; right side 760 and left side 763 each can comprise a length of approximately 122.23 centimeters; bottom side 759 and bottom side 762 each can comprise a length of approximately 8.10 centimeters; and/or top side 754 and top side 758 each can comprise a length of approximately 11.45 centimeters. Meanwhile, holes 764-767 can be located approximately 9.84 centimeters, 37.78 centimeters, 84.14 centimeters, and 122.24 centimeters from bottom side 759, respectively; and holes 768-771 can be located approximately 9.84 centimeters, 37.78 centimeters, 84.14 centimeters, and 122.24 centimeters from bottom side 762, respectively. Further, each of holes 764-767 can be centered approximately halfway between right crease 756 and right side 760, and each of holes 767-771 can be centered halfway between left crease 757 and left side 763.

Figure 8:
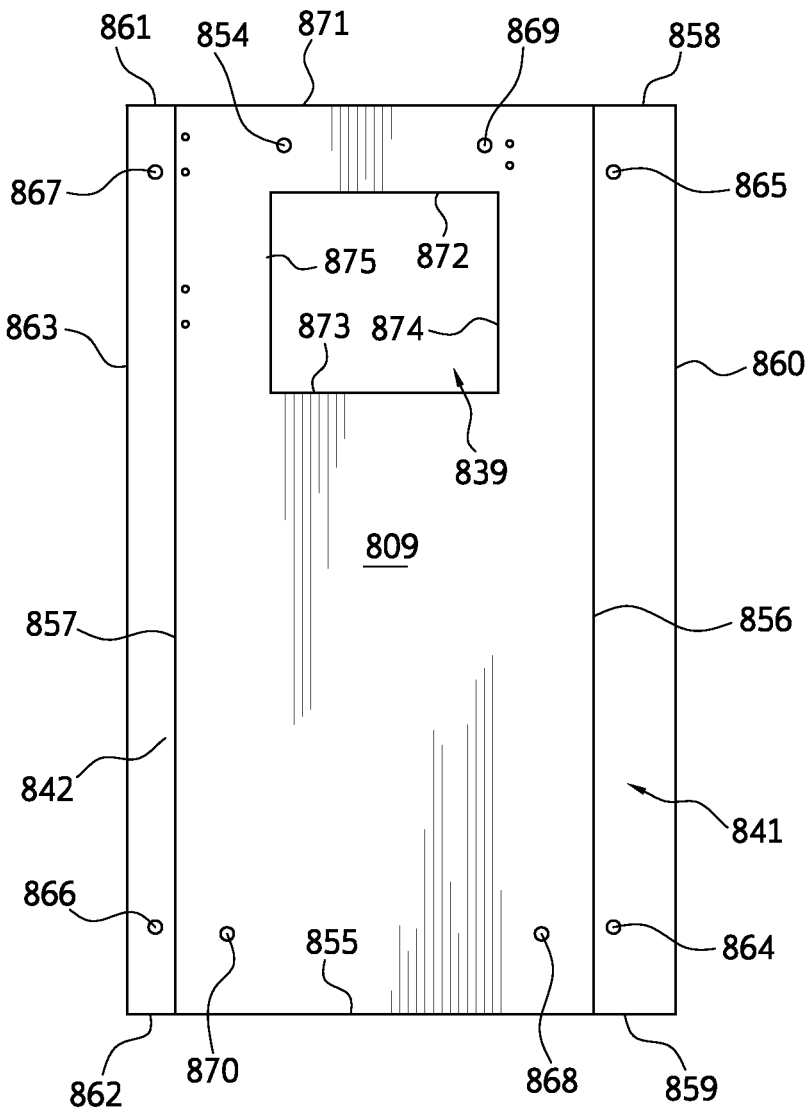
FIG. 8 illustrates a two dimensional schematic of an exemplary front AP, front right wing, and front left wing of the system, according to the embodiment of FIG. 7.

Turning to the next drawing, FIG. 8 illustrates a two dimensional schematic of exemplary front AP 809, front right wing 841, and/or front left wing 842 of system 700, according to the embodiment of FIG. 7. In many embodiments, front AP 809 can be similar or identical to front AP 209 (FIG. 2); front right wing 841 can be similar or identical to front right wing 241 (FIG. 2); and/or front left wing 842 can be similar or identical to front left wing 342 (FIG. 3). Further, in other embodiments, front AP 809 can be similar or identical to rear AP 2109 (FIGS. 21 & 22).

Meanwhile, front AP 809 can comprise top side 854, bottom side 855, right crease 856, and left crease 857. Further, front right wing 841 can comprise top side 858, bottom side 859, right side 860, and right crease 856; and front left wing 842 can comprise top side 861, bottom side 862, left side 863, and left crease 857.

Also, front AP 809, front right wing 841, and/or front left wing 842 can comprise holes 864-871. In some embodiments, front right wing 841 comprises holes 864 and 865, front left wing 842 comprises holes 866 and 867, and front AP 809 comprises holes 868-871.

Further, front AP 809 can comprise aperture 839. Aperture 839 can be similar or identical to aperture 239 (FIG. 2). Aperture 839 can comprise aperture top side 872, aperture bottom side 873, aperture right side 874, and aperture left side 875.

Top side 854 can be approximately parallel with bottom side 855, and approximately perpendicular with right crease 856 and left crease 857. Right crease 856 can be approximately parallel with right side 860 and approximately perpendicular with top side 858 and bottom side 859. Meanwhile, left crease 857 can be approximately parallel with left side 863 and approximately perpendicular with top side 861 and bottom side 862. Meanwhile, aperture top side 872 can be approximately parallel with aperture bottom side 873 and approximately perpendicular with aperture right side 874 and aperture left side 875.

Further, in some embodiments, holes 864 and 865 can be arranged to form a straight line at front right wing 841 that is approximately perpendicular to bottom side 859, and/or holes 866 and 867 can be arranged to form a straight line at front left wing 842 that is approximately perpendicular to bottom side 862. Meanwhile, front AP 809 can be approximately perpendicular to front right wing 841 at right crease 856 and approximately perpendicular to front left wing 842 at left crease 857.

In many embodiments, top side 854 and bottom side 855 each can comprise a length of approximately 39.69 centimeters; right crease 856, left crease 857, right side 860, and left side 863 each can comprise a length of approximately 86.36 centimeters; top side 854 and bottom side 859 each can comprise a length of approximately 7.78 centimeters; top side 858 and bottom side 862 each can comprise a length of approximately 7.60 centimeters. Meanwhile, aperture top side 872 and aperture bottom side 873 each can comprise a length of approximately 21.59 centimeters; and aperture right side 874 and aperture left side 875 each can comprise a length of approximately 19.05 centimeters.

In these or other embodiments, holes 864 and 865 can be located approximately 1.91 centimeters from right crease 856, and holes 866 and 867 can be located approximately 1.91 centimeters from left crease 857. Further, hole 864 can be located approximately 8.26 centimeters from bottom side 859, and hole 866 can be located approximately 8.26 centimeters from bottom side bottom side 862. Further still, hole 865 can be located approximately 6.35 centimeters from top side 854, and hole 867 can be located approximately 6.35 centimeters from top side 858.

Meanwhile, hole 868 can be located approximately 4.92 centimeters from right crease 856 and approximately 7.62 centimeters from bottom side 855; hole 870 can be located approximately 4.92 centimeters from left crease 857 and approximately 7.62 centimeters from bottom side 855; hole 869 can be located approximately 10.31 centimeters from right crease 856 and approximately 3.81 centimeters from top side 854; and hole 871 can be located approximately 10.31 centimeters from left crease 857 and approximately 3.81 centimeters from top side 854.

Further, aperture top side 872 can be located approximately 8.26 centimeters from top side 854; aperture right side 874 can be located approximately 9.05 centimeters from right crease 856; and aperture left side 875 can be located approximately 9.05 centimeters from left crease 857.

Figure 9:
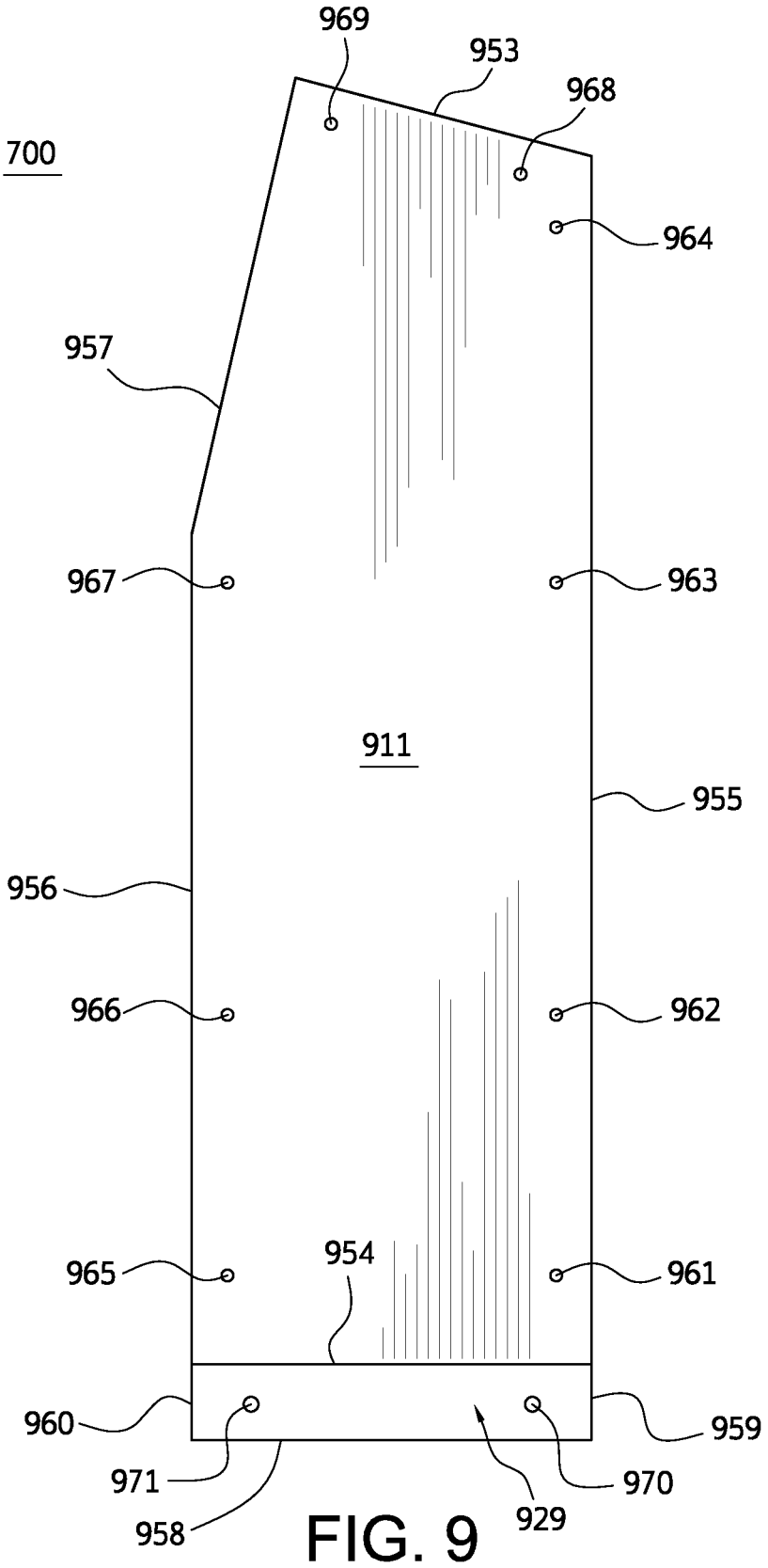
FIG. 9 illustrates a two dimensional schematic of an exemplary right AP and right foot of the system, according to the embodiment of FIG. 7.

Turning to the next drawing, FIG. 9 illustrates a two dimensional schematic of exemplary right AP 911 and/or right foot 929 of system 700, according to the embodiment of FIG. 7. In many embodiments, right AP 911 can be similar or identical to right AP 211 (FIG. 2); and right foot 929 can be similar or identical to right foot 229 (FIG. 2). Further, in other embodiments, right AP 911 can be similar or identical to right AP 2111 (FIGS. 21 & 22), and right foot 929 can be similar or identical to right foot 2129 (FIGS. 21 & 22).

Right AP 911 can comprise top side 953, crease 954, rear side 955, bottom front side 956, top front side 957. Further, right foot 929 can comprise crease 954, bottom side 958, right side 959, and left side 960.

Also, right AP 911 and/or right foot 929 can comprise holes 961-971. In some embodiments, right AP 911 comprises holes 961-969 and right foot 929 comprises holes 970 and 971.

Rear side 955 can be approximately parallel with bottom front side 956, and approximately perpendicular with crease 954. Crease 954 can be approximately parallel with bottom side 958 and approximately perpendicular with right side 959 and left side 960.

Further, in some embodiments, holes 961-964 can be arranged to form a straight line at right AP 911 that is approximately perpendicular to crease 954, and/or holes 965-967 can be arranged to form a straight line at right AP 911 that is approximately perpendicular to crease 954. Meanwhile, right AP 911 can be approximately perpendicular to right foot 929 at crease 954.

In many embodiments, top side 953 can comprise a length of approximately 32.84 centimeters; crease 954 and bottom side 958 each can comprise a length of approximately 42.86 centimeters, rear side 955 can comprise a length of approximately 129.54 centimeters; bottom front side 956 can comprise a length of approximately 89.06 centimeters; top front side 957 can comprise a length of approximately 50.14 centimeters; and right side 959 and left side 960 each can comprise a length of approximately 8.10 centimeters.

In these or other embodiments, holes 961-964 can be located approximately 3.81 centimeters from rear side 955, and holes 965-967 can be located approximately 3.81 centimeters from bottom front side 956. Further, holes 961 and 965 can be located approximately 9.53 centimeters from crease 954, holes 962 and 966 can be located approximately 37.47 centimeters from crease 954, holes 963 and 967 can be located approximately 83.82 centimeters from crease 954, and hole 967 can be located approximately 121.92 centimeters from crease 954. Meanwhile, hole 970 can be located approximately 3.84 centimeters from bottom side 958 and 6.34 centimeters from right side 959, and hole 971 can be located approximately 3.84 centimeters from bottom side 958 and 6.34 centimeters from left side 960.

Notably, although not illustrated, system 700 can also comprise a left AP and/or left foot. In many embodiments, the left AP can be similar or identical to left AP 212 (FIG. 2) and/or left AP 2112 (FIGS. 21 & 22); and the left foot can be similar or identical to left foot 2232 (FIG. 22). Further, the left AP can be similar to right AP 911 and the left foot can be similar to right foot 929 but that the left AP and left foot mirror right AP 911 and right foot 929, respectively.

Figure 10:
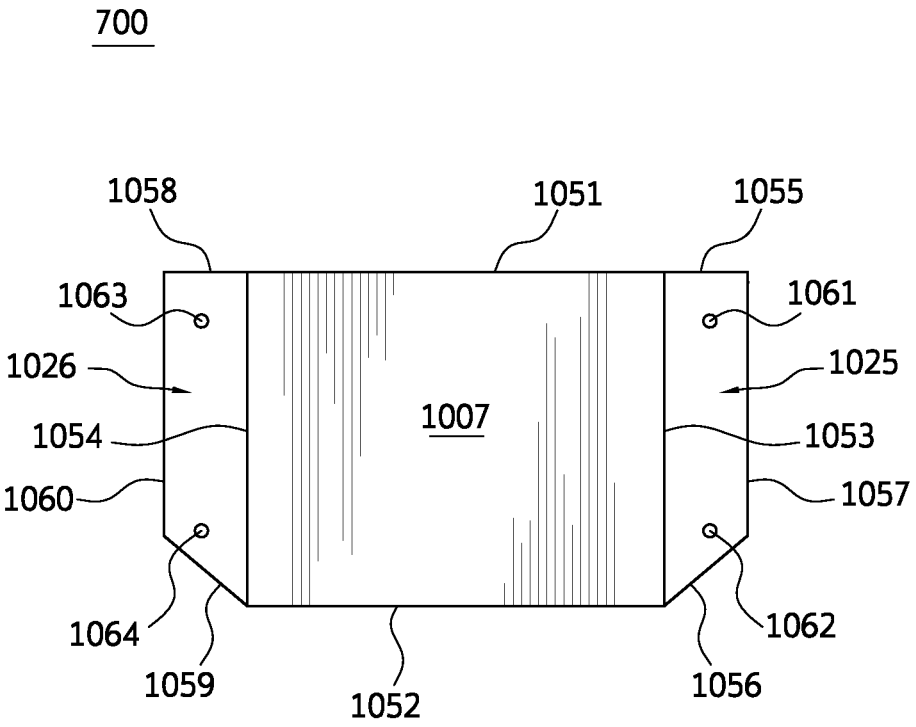
FIG. 10 illustrates a two dimensional schematic of an exemplary top AP, top right wing, and top left wing of the system, according to the embodiment of FIG. 7.

Turning again to the next drawing, FIG. 10 illustrates a two dimensional schematic of exemplary top AP 1007, top right wing 1025, and top left wing 1026 of system 700, according to the embodiment of FIG. 7. In many embodiments, top AP 1007 can be similar or identical to top AP 207 (FIG. 2); top right wing 1025 can be similar or identical to top right wing 225 (FIG. 2); and/or top left wing 1026 can be similar or identical to top left wing 326 (FIG. 3). Further, in other embodiments, top AP 1007 can be similar or identical to top AP 2107 (FIGS. 21 & 22).

Top AP 1007 can comprise front side 1051, rear side 1052, right crease 1053, and left crease 1054. Further, top right wing 1025 can comprise front side 1055, rear side 1056, right side 1057, and right crease 1053; and top left wing 1026 can comprise front side 1058, rear side 1059, left side 1060, and left crease 1054.

Also, rear AP 710, rear right wing 727, and/or rear left wing 728 can comprise holes 1061-1064. In some embodiments, top right wing 1025 comprises holes 1061 and 1062, and top left wing 1026 comprises holes 1063 and 1064.

Front side 1051 can be approximately parallel with rear side 1052, and approximately perpendicular with right crease 1053 and left crease 1054. Right crease 1053 can be approximately parallel with right side 1057 and approximately perpendicular with front side 1055. Further, right crease 1053 can form a 45 degree angle with rear side 1056. Meanwhile, left crease 1054 can be approximately parallel with left side 1060 and approximately perpendicular with front side 1058. Further, left crease 1054 can form a 45 degree angle with rear side 1059.

Further, in some embodiments, holes 1061 and 1062 can be arranged to form a straight line at top right wing 1025 that is approximately perpendicular to front side 1055, and/or holes 1063 and 1064 can be arranged to form a straight line at top left wing 1026 that is approximately perpendicular to front side 1058. Meanwhile, top AP 1007 can be approximately perpendicular to top right wing 1025 at right crease 1053 and approximately perpendicular to rear left wing 1026 at left crease 1054.

In many embodiments, front side 1051 and rear side 1052 each can comprise a length of approximately 40.32 centimeters; right crease 1053 and left crease 1054 each can comprise a length of approximately 32.39 centimeters; right side 1057 and left side 1060 each can comprise a length of approximately 25.56 centimeters; front side 1055 and front side 1058 each can comprise a length of approximately 8.10 centimeters; and/or rear side 1056 and rear side 1059 each can comprise a length of approximately 11.45 centimeters. Meanwhile, holes 1061 and 1062 each can be located approximately 3.64 centimeters from right side 1057, and holes 1063 and 1064 each can be located approximately 3.64 centimeters from left side 1060.

Figure 11:
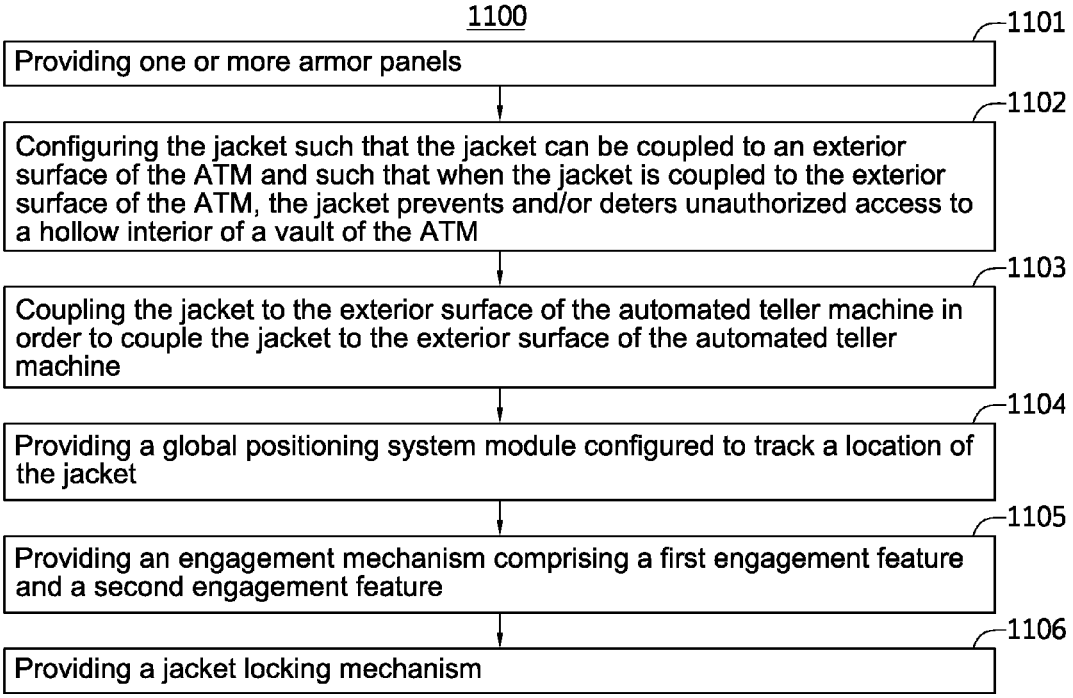
FIG. 11 illustrates a flow chart for an embodiment of a method of providing a jacket for an automated teller machine (ATM)

Turning ahead again in the drawings, FIG. 11 illustrates a flow chart for an embodiment of method 1100 of providing a jacket for an automated teller machine (ATM). In many embodiments, the jacket can be similar or identical to jacket 224 (FIGS. 2-6), system 700 (FIGS. 7-10), and/or jacket 2124 (FIGS. 21 & 22), and the ATM can be similar or identical to ATM 100 (FIG. 1). Method 1100 is merely exemplary and is not limited to the embodiments presented herein. Method 1100 can be employed in many different embodiments or examples not specifically depicted or described herein. In some embodiments, the activities, the procedures, and/or the processes of method 1100 can be performed in the order presented. In other embodiments, the activities, the procedures, and/or the processes of method 1100 can be performed in any other suitable order. In still other embodiments, one or more of the activities, the procedures, and/or the processes in method 1100 can be combined or skipped.

Figure 12:
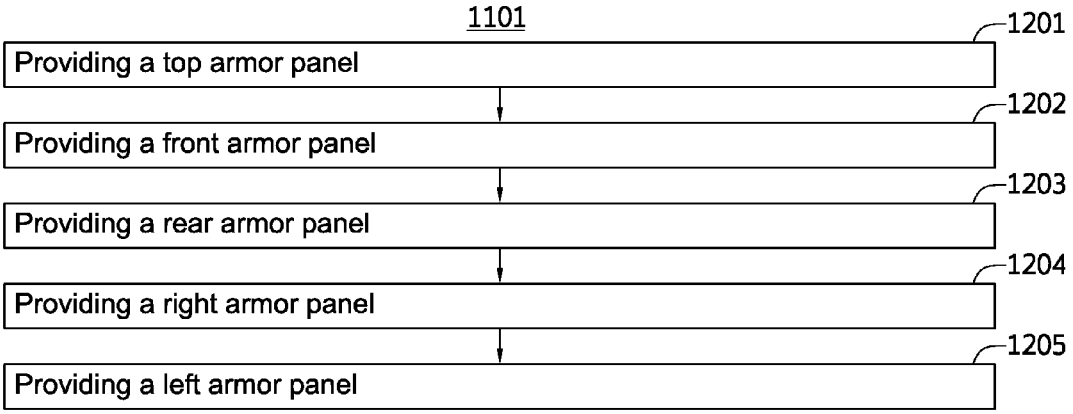
FIG. 12 illustrates an exemplary activity of providing one or more armor panels, according to the embodiment of FIG. 11.

In many embodiments, method 1100 can comprise activity 1101 of providing one or more armor panels. In these or other embodiments, the armor panel(s) can be similar or identical to the armor panel(s) described above with respect to jacket 224 (FIGS. 2-6), system 700 (FIGS. 7-10), and/or armor panels 2192 (FIGS. 21 & 22). FIG. 12 illustrates an exemplary activity 1101, according to the embodiment of FIG. 11.

Figure 13:
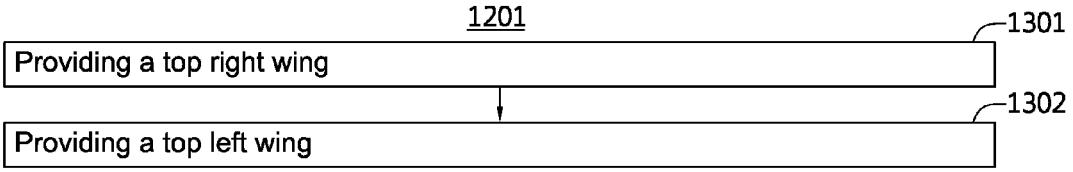
FIG. 13 illustrates an exemplary activity of providing a top armor panel, according to the embodiment of FIG. 11.

In some embodiments, activity 1101 can comprise activity 1201 of providing a top armor panel. In many embodiments, the top armor panel can be similar or identical to top AP 207 (FIG. 2) and/or top AP 2107 (FIGS. 21 & 22). FIG. 13 illustrates an exemplary activity 1201, according to the embodiment of FIG. 11.

For example, activity 1201 in FIG. 13 can comprise activity 1301 of providing a top right wing. In many embodiments, the top right wing can be similar or identical to top right wing 225 (FIG. 2). In some embodiments, activity 1301 can be omitted.

Further, activity 1201 in FIG. 13 can comprise activity 1302 of providing a top left wing. In many embodiments, the top left wing can be similar or identical to top left wing 326 (FIG. 3). In some embodiments, activity 1302 can be performed before, after, or approximately simultaneously with activity 1301. In other embodiments, activity 1302 can be omitted.

Figure 14:
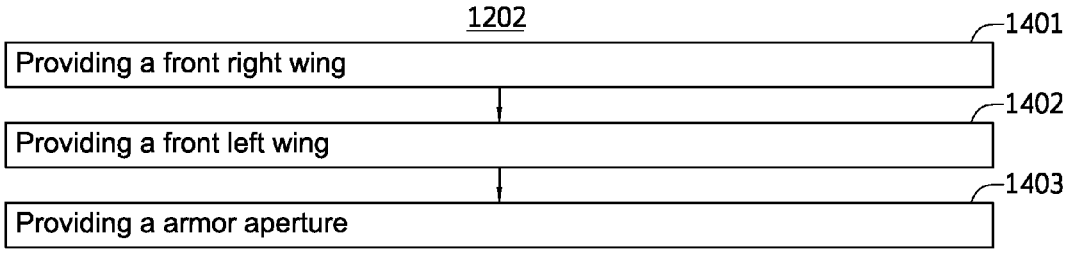
FIG. 14 illustrates an exemplary activity of providing a front armor panel, according to the embodiment of FIG. 11.

Turning now back to FIG. 12, activity 1101 can comprise activity 1202 of providing a front armor panel. In many embodiments, the front armor panel can be similar or identical to front AP 209 (FIG. 2) and/or front AP 2109 (FIGS. 21 & 22). FIG. 14 illustrates an exemplary activity 1202, according to the embodiment of FIG. 11.

For example, activity 1202 in FIG. 14 can comprise activity 1401 of providing a front right wing. In many embodiments, the front right wing can be similar or identical to front right wing 241 (FIG. 2). In some embodiments, activity 1401 can be omitted.

Further, activity 1202 in FIG. 14 can comprise activity 1402 of providing a front left wing. In many embodiments, the front left wing can be similar or identical to front left wing 342 (FIG. 3). In some embodiments, activity 1402 can be performed before, after, or approximately simultaneously with activity 1401. In other embodiments, activity 1402 can be omitted.

Further still, activity 1202 in FIG. 14 can comprise activity 1403 of providing an armor aperture. In many embodiments, the armor aperture can be similar or identical to aperture(s) 239 (FIG. 2). In some embodiments, activity 1402 can be performed before, after, or approximately simultaneously with activity 1401 and/or activity 1402. In other embodiments, activity 1403 can be omitted.

Figure 15:
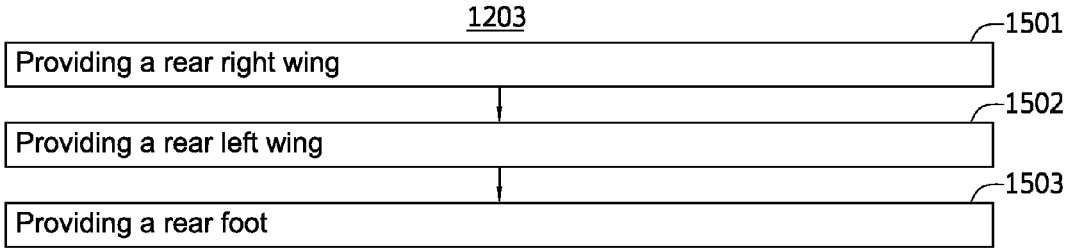
FIG. 15 illustrates an exemplary activity of providing a rear armor panel, according to the embodiment of FIG. 11.

Returning again to FIG. 12, activity 1101 can comprise activity 1203 of providing a rear armor panel. In many embodiments, the rear armor panel can be similar or identical to rear AP 210 (FIG. 2) and/or rear AP 2110 (FIGS. 21 & 22). FIG. 15 illustrates an exemplary activity 1203, according to the embodiment of FIG. 11.

For example, activity 1203 in FIG. 15 can comprise activity 1501 of providing a rear right wing. In many embodiments, the rear right wing can be similar or identical to rear right wing 227 (FIG. 2). In some embodiments, activity 1501 can be omitted.

Further, activity 1203 in FIG. 15 can comprise activity 1502 of providing a rear left wing. In many embodiments, the rear left wing can be similar or identical to rear left wing 328 (FIG. 3). In some embodiments, activity 1502 can be performed before, after, or approximately simultaneously with activity 1501. In other embodiments, activity 1502 can be omitted.

Further still, activity 1203 in FIG. 15 can comprise activity 1503 of providing a rear foot. In many embodiments, the rear foot can be similar or identical to the rear foot described above with respect to system 200 (FIGS. 2-6) and/or system 2100 (FIGS. 21 & 22). In some embodiments, activity 1503 can be performed before, after, or approximately simultaneously with activity 1501 and/or activity 1502. In other embodiments, activity 1503 can be omitted.

Figure 16:
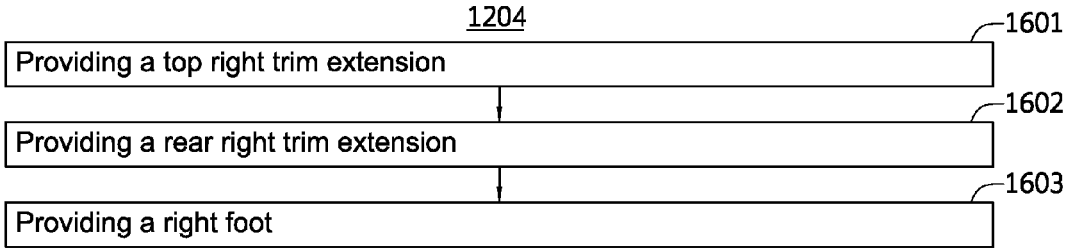
FIG. 16 illustrates an exemplary activity of providing a right armor panel, according to the embodiment of FIG. 11.

Returning again to FIG. 12, activity 1101 can comprise activity 1204 of providing a right armor panel. In many embodiments, the right armor panel can be similar or identical to right AP 211 (FIG. 2) and/or right AP 2111 (FIGS. 21 & 22). FIG. 16 illustrates an exemplary activity 1204, according to the embodiment of FIG. 11.

For example, activity 1204 in FIG. 16 can comprise activity 1601 of providing a top right trim extension. In many embodiments, the top right trim extension can be similar or identical to top right rim extension 231 (FIG. 2). In some embodiments, activity 1601 can be omitted, such as, for example, when activity 1301 is omitted.

Further, activity 1204 in FIG. 16 can comprise activity 1602 of providing a rear right trim extension. In many embodiments, the rear right trim extension can be similar or identical to rear right trim extension 230 (FIG. 2). In some embodiments, activity 1602 can be omitted, such as, for example, when activity 1501 is omitted. In some embodiments, activity 1602 can be performed before, after, or approximately simultaneously with activity 1601.

Further still, activity 1204 in FIG. 16 can comprise activity 1603 of providing a right foot. In many embodiments, the right foot can be similar or identical to right foot 229 (FIG. 2) and/or right foot 2129 (FIG. 21). In some embodiments, activity 1603 can be performed before, after, or approximately simultaneously with activity 1601 and/or activity 1602. In other embodiments, activity 1603 can be omitted.

In some embodiments, activity 1204 can comprise an activity of folding the right armor panel so as to be approximately perpendicular to the rear armor panel.

Figure 17:
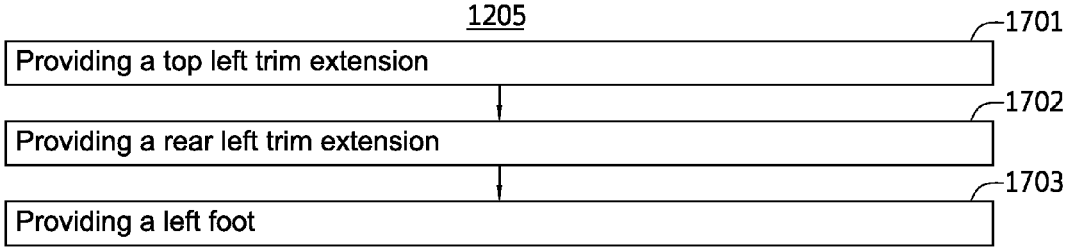
FIG. 17 illustrates an exemplary activity of providing a left armor panel, according to the embodiment of FIG. 11.

Returning again to FIG. 12, activity 1101 can comprise activity 1205 of providing a left armor panel. In many embodiments, the left armor panel can be similar or identical to left AP 212 (FIG. 2) and/or left AP 2112 (FIGS. 21 & 22). FIG. 17 illustrates an exemplary activity 1205, according to the embodiment of FIG. 11.

For example, activity 1205 in FIG. 17 can comprise activity 1701 of providing a top left trim extension. In many embodiments, the top left trim extension can be similar or identical to top left trim extension 334 (FIG. 3). In some embodiments, activity 1701 can be omitted, such as, for example, when activity 1302 is omitted.

Further, activity 1205 in FIG. 17 can comprise activity 1702 of providing a rear left trim extension. In many embodiments, the rear left trim extension can be similar or identical to rear left trim extension 333 (FIG. 3). In some embodiments, activity 1702 can be omitted, such as, for example, when activity 1502 is omitted. In some embodiments, activity 1702 can be performed before, after, or approximately simultaneously with activity 1701.

Further still, activity 1205 can comprise activity 1703 of providing a left foot. In many embodiments, the left foot can be similar or identical to left foot 332 (FIG. 3) and/or left foot 2232 (FIG. 22). In some embodiments, activity 1703 can be performed before, after, or approximately simultaneously with activity 1701 and/or activity 1702. In other embodiments, activity 1703 can be omitted.

In some embodiments, activity 1205 can comprise an activity of folding the left armor panel so as to be approximately perpendicular to the rear armor panel.

In various embodiments, two or more of activities 1203 through 1205 can be performed approximately simultaneously with each other.

Figure 18:
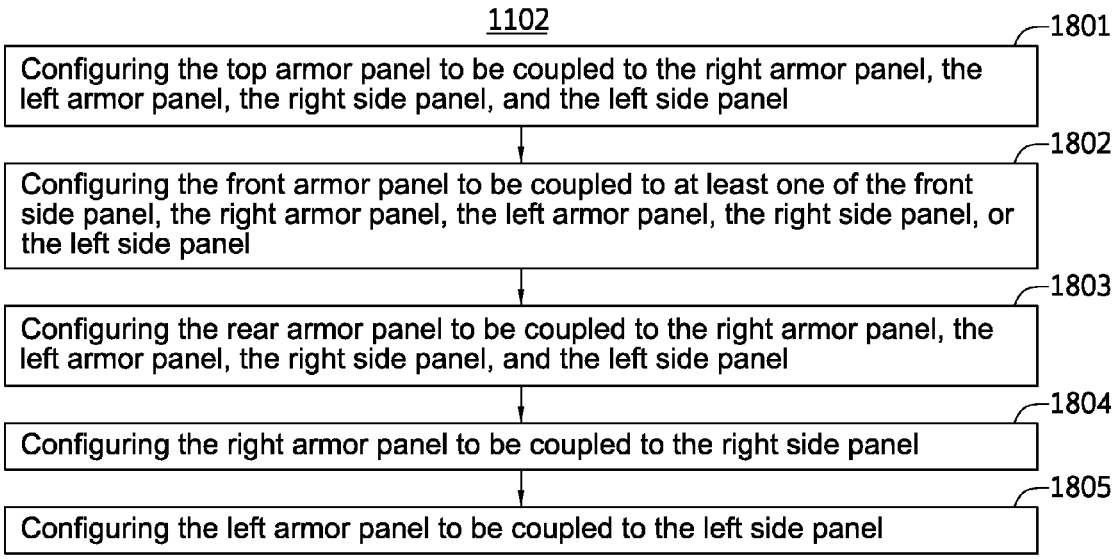
FIG. 18 illustrates an exemplary activity of configuring the jacket such that the jacket can be coupled to an exterior surface of the ATM and such that when the jacket is coupled to the exterior surface of the ATM, the jacket prevents and/or deters unauthorized access to a hollow interior of a vault of the ATM when the activity comprises configuring at least one of the one or more armor panels to be coupled to the exterior surface of the ATM in order to couple the jacket to the exterior surface of the ATM, according to the embodiment of FIG. 11.

Turning now back to FIG. 11, method 1100 also can comprise activity 1102 of configuring the jacket such that the jacket can be coupled to an exterior surface of the ATM and such that when the jacket is coupled to the exterior surface of the ATM, the jacket prevents and/or deters unauthorized access to a hollow interior of a vault of the ATM. In many embodiments, activity 1102 can comprise an activity of configuring at least one of the one or more armor panels to be coupled to the exterior surface of the ATM in order to couple the jacket to the exterior surface of the ATM. FIG. 18 illustrates an exemplary activity 1102 when activity 1102 comprises the activity of configuring at least one of the armor panel(s) to be coupled to the exterior surface of the ATM in order to couple the jacket to the exterior surface of the ATM, according to the embodiment of FIG. 11.

Figure 19:
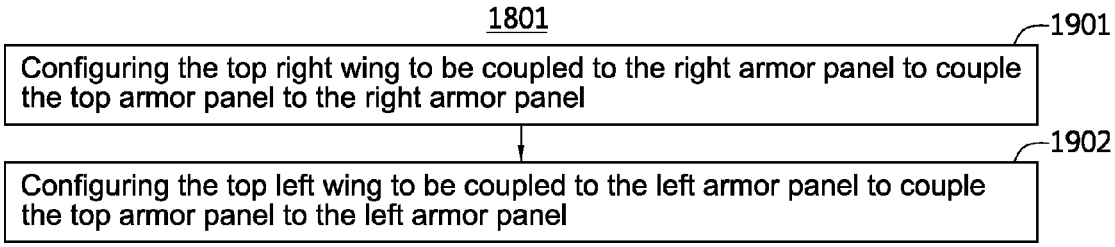
FIG. 19 illustrates an exemplary activity of configuring the top armor panel to be coupled to the right armor panel, the left armor panel, the right side panel, and the left side panel, according to the embodiment of FIG. 11.

For example, activity 1102 in FIG. 18 can comprise activity 1801 of configuring the top armor panel to be coupled to the right armor panel, the left armor panel, the right side panel, and/or the left side panel. In some embodiments, activity 1801 can comprise an activity of bonding (e.g., by welding) the top armor panel to the right armor panel and/or the left armor panel. FIG. 19 illustrates an exemplary activity 1801, according to the embodiment of FIG. 11.

For example, activity 1801 in FIG. 19 can comprise activity 1901 of configuring the top right wing to be coupled to the right armor panel to couple the top armor panel to the right armor panel. In some embodiments, activity 1901 can be omitted, such as, for example, when activity 1401 is omitted, and/or when the top armor panel is bonded to the right armor panel.

Further, activity 1801 in FIG. 19 can comprise activity 1902 of configuring the top left wing to be coupled to the left armor panel to couple the top armor panel to the left armor panel. In some embodiments, activity 1902 can be omitted, such as, for example, when activity 1402 is omitted, and/or when the top armor panel is bonded to the left armor panel.

Meanwhile, turning back to FIG. 18, activity 1102 can comprise activity 1802 of configuring the front armor panel to be coupled to at least one of the front side panel, the right armor panel, the left armor panel, the right side panel, or the left side panel.

Figure 20:
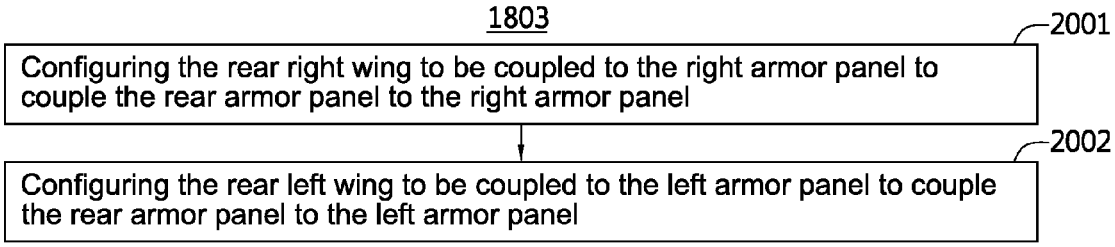
FIG. 20 illustrates an exemplary activity of configuring the rear armor panel to be coupled to the right armor panel, the left armor panel, the right side panel, and the left side panel, according to the embodiment of FIG. 11.

Further, activity 1102 can comprise activity 1803 of configuring the rear armor panel to be coupled to the right armor panel, the left armor panel, the right side panel, and/or the left side panel. In some embodiments, activity 1803 can be omitted. FIG. 20 illustrates an exemplary activity 1803, according to the embodiment of FIG. 11.

For example, activity 1803 in FIG. 20 can comprise activity 2001 of configuring the rear right wing to be coupled to the right armor panel to couple the rear armor panel to the right armor panel. In some embodiments, activity 2001 can be omitted, such as, for example, when activity 1501 is omitted, and/or when the right armor panel is a unitary element with the rear armor panel.

Further, activity 1803 in FIG. 20 can comprise activity 2002 of configuring the rear left wing to be coupled to the left armor panel to couple the rear armor panel to the left armor panel. In some embodiments, activity 2002 can be omitted, such as, for example, when activity 1502 is omitted, and/or when the left armor panel is a unitary element with the rear armor panel.

Turning again back to FIG. 18, in these or other embodiments, activity 1102 can comprise activity 1804 of configuring the right armor panel to be coupled to the right side panel. Further, activity 1102 can comprise activity 1805 of configuring the left armor panel to be coupled to the left side panel.

Further, activity 1102 can comprise an activity of configuring the top armor panel to be coupled to the rear armor panel. In these embodiments, the activity can further comprise an activity of bonding (e.g., by welding) the top armor panel to the rear armor panel, and/or the activity can be performed approximately simultaneously with part or all of activities 1801 and/or 1802.

In some embodiments, part or all of one or more of activities 1801 through 1805 can be performed by drilling apertures in the respective armor panels of the relevant activity or activities. The apertures can be similar or identical to the apertures described above with respect to system 200 (FIGS. 2-6).

Returning now to FIG. 11, in some embodiments, method 1100 can comprise activity 1103 of coupling the jacket to the exterior surface of the automated teller machine in order to couple the jacket to the exterior surface of the automated teller machine. For example, activity 1103 can comprise: (i) an activity of mechanically coupling (e.g., by bolting and/or screwing) the jacket to the exterior surface of the automated teller machine in order to couple the jacket to the exterior surface of the automated teller machine; or (ii) an activity of bonding (e.g., by welding and/or by adhering) the jacket to the exterior surface of the automated teller machine in order to couple the jacket to the exterior surface of the automated teller machine. In some embodiments, activity 1103 can be omitted.

Further, method 1100 can comprise activity 1104 of providing a global positioning system module configured to track a location of the jacket. In some embodiments, activity 1104 can be omitted. The global positioning system module can be similar or identical to the global positioning system module described above with respect to system 200 (FIG. 2).

Also, method 1100 can comprise activity 1105 of providing an engagement mechanism comprising a first engagement feature and a second engagement feature. In many embodiments, the engagement mechanism can be similar or identical to first engagement mechanism 235 (FIG. 2). Further, the first engagement feature can be similar or identical to front engagement feature 236, and the second engagement feature can be similar or identical to side engagement feature 237. In various embodiments, activity 1105 can be omitted.

In some embodiments, activity 1106 can comprise an activity of providing a shroud configured to at least partially enclose the engagement mechanism. The shroud can be similar or identical to the shroud described above with respect to system 200 (FIGS. 2-6).

Meanwhile, in these or other embodiments, method 1100 can comprise activity 1106 of providing a jacket locking mechanism. In many embodiments, the jacket locking mechanism can be similar or identical to the jacket locking mechanism described above with respect to system 200 (FIGS. 2-6). Meanwhile, in some embodiments, activity 1105 can comprise an activity of providing a puck lock. In other embodiments, activity 1106 can be omitted.

In many embodiments, one or more of the procedure, processes, and/or activities of method 1100 (e.g., activities 1101, 1102, 1105, 1106, 1201-1205, 1301, 1302, 1401-1403, 1501-1503, 1601-1603, 1801-1805, 1901, 1902, 2001, and/or 2002) can be performed using any suitable material manufacturing techniques. In particular, one or more of the procedure, processes, and/or activities of method 1100 (e.g., activities 1101, 1102, 1105, 1106, 1201-1205, 1301, 1302, 1401-1403, 1501-1503, 1601-1603, 1801-1805, 1901, 1902, 2001, and/or 2002) can be performed using any suitable metallurgical material manufacturing techniques. Exemplary metallurgical material manufacturing techniques can include casting, forging, flow forming, rolling, laser cladding, extrusion, sintering, machining (e.g., lathing, drilling, sawing, milling, etc.), fabrication, etc.

Although the invention has been described with reference to specific embodiments, it will be understood by those skilled in the art that various changes may be made without departing from the spirit or scope of the invention. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that the any of the methods described herein may be comprised of many different activities, processes, and/or procedures, can be performed by many different modules, in many different orders, that any element of FIGS. 1-22 may be modified, and that the foregoing discussion of certain of these embodiments does not necessarily represent a complete description of all possible embodiments.

Generally, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A system comprising:

a jacket comprising multiple armor panels;

wherein:

the jacket is configured to be coupled to an exterior surface of an automated teller machine, the automated teller machine comprising the exterior surface and a vault that comprises a hollow interior;

the exterior surface of the automated teller machine comprises multiple side panels, the multiple side panels being arranged in different planes relative to each other;

at least one of the multiple armor panels is configured to be coupled to the exterior surface of the automated teller machine in order to couple the jacket to the exterior surface of the automated teller machine;

the multiple armor panels comprise a first armor panel unit;

the first armor panel unit comprises multiple first armor panel unit sections;

and when the jacket is coupled to the exterior surface of the automated teller machine:

the multiple first armor panel unit sections correspond to and abut different side panels of the multiple side panels at the exterior surface of the automated teller machine such that the multiple first armor panel unit sections wrap continuously about the exterior surface to cover the different side panels of the multiple side panels;

and the jacket is configured to at least one of prevent or deter unauthorized access to the hollow interior of the vault of the automated teller machine.

2. The system of claim 1 wherein:

the system comprises a global positioning system module configured to track a location of the jacket.

3. The system of claim 1 wherein:

the multiple side panels comprise a front side panel, a rear side panel, a right side panel, and a left side panel; and the multiple armor panels comprise a front armor panel section, a rear armor panel section, a right armor panel section, and a left armor panel section corresponding to the front side panel, the rear side panel, the right side panel, and the left side panel.

4. The system of claim 3 wherein:

the multiple first armor panel unit sections comprise the rear armor panel section, the right armor panel section, and the left armor panel section; and the rear armor panel section, the right armor panel section, and the left armor panel section form a single unitary body when the multiple first armor panel unit sections are decoupled from the exterior surface of the automated teller machine.

5. The system of claim 3 wherein:

the multiple armor panels are harder than the multiple side panels.

6. The system of claim 3 wherein at least one of:

the right armor panel section comprises a right foot configured to be coupled to an other surface separate from the jacket and the automated teller machine, and the right armor panel section and the right foot form one first continuous piece when the jacket is decoupled from the exterior surface of the automated teller machine;

the left armor panel section comprises a left foot configured to be coupled to the other surface separate from the jacket and the automated teller machine, and the left armor panel section and the left foot form one second continuous piece when the jacket is decoupled from the exterior surface of the automated teller machine; or the rear armor panel section comprises a rear foot configured to be coupled to the other surface separate from the jacket and the automated teller machine, and the rear armor panel section and the rear foot form one third continuous piece when the jacket is decoupled from the exterior surface of the automated teller machine.

7. The system of claim 3 wherein:

the front armor panel section comprises a front right wing, a front left wing, and an armor aperture;

the front right wing and the front left wing extend from and are approximately perpendicular to a central part of the front armor panel section; and the armor aperture is configure to provide access to a dispensing aperture of the automated teller machine when the front armor panel section is coupled to the exterior surface of the automated teller machine.

8. The system of claim 3 wherein:

the jacket comprises a jacket locking mechanism and an engagement mechanism comprising a first engagement feature and a second engagement feature; and the jacket locking mechanism is configured to be received at the engagement mechanism to couple the first engagement feature to the second engagement feature in order to maintain the front armor panel section in a closed position.

9. The system of claim 8 wherein:

the jacket locking mechanism comprises a puck lock.

10. The system of claim 1 wherein:

the multiple side panels comprise a front side panel, a top side panel, a rear side panel, a right side panel, and a left side panel; and the multiple armor panels comprise a front armor panel section, a top armor panel section, a rear armor panel section, a right armor panel section, and a left armor panel section corresponding to the front side panel, the top side panel, the rear side panel, the right side panel, and the left side panel of the multiple side panels.

11. The system of claim 10 wherein:

the multiple first armor panel unit sections comprise the rear armor panel section, the top armor panel section, the right armor panel section, and the left armor panel section; and the rear armor panel section, the top armor panel section, the right armor panel section, and the left armor panel section form a single unitary body when the multiple first armor panel unit sections are decoupled from the exterior surface of the automated teller machine.

12. The system of claim 10 wherein:

the top armor panel section is bonded directly to at least one of the rear armor panel section, the right armor panel section, or the left armor panel section.

13. The system of claim 10 wherein:

the top armor panel section is configured to be coupled directly to the right armor panel section, the left armor panel section, the right side panel, and the left side panel; and the rear armor panel section is configured to be coupled directly to the right armor panel section, the left armor panel section, the right side panel, and the left side panel.

14. The system of claim 10 wherein:

the front armor panel section is configured to be coupled directly to at least one of the front side panel, the right armor panel section, the left armor panel section, the right side panel, or the left side panel;

the right armor panel section is configured to be coupled directly to the right side panel; and the left armor panel section is configured to be coupled directly to the left side panel.

15. The system of claim 1 wherein:

the jacket is configured to be bolted to the exterior surface of the automated teller machine in order to couple the jacket to the exterior surface of the automated teller machine.

16. The system of claim 1 wherein:

each of the multiple armor panels comprises a thickness; and at least one of:

the thickness is greater than or equal to approximately 0.470 centimeters and less than or equal to approximately 2.54 centimeters; or the thickness comprises one of approximately 0.476 centimeters, approximately 0.478 centimeters, or approximately 0.635 centimeters.

17. The system of claim 1 wherein:

the multiple armor panels comprise at least one of steel, stainless steel, or aluminum.

18. A method of providing a jacket for an automated teller machine, the automated teller machine comprising (a) an exterior surface having multiple side panels arranged in different planes relative to each other and (b) a vault having a hollow interior, the method comprising:

providing multiple armor panels of the jacket; and configuring the jacket such that the jacket is able to prevent or deter unauthorized access to the hollow interior of the vault of the automated teller machine;

wherein:

providing the multiple armor panels comprises:

providing a first armor panel unit comprising multiple first armor panel unit sections; and configuring the multiple armor panels such that when the jacket is coupled to the exterior surface of the automated teller machine, the multiple first armor panel unit sections correspond to and abut different side panels of the multiple side panels at the exterior surface of the automated teller machine such that the multiple first armor panel unit sections wrap continuously about the exterior surface to cover the different side panels of the multiple side panels;

configuring the jacket such that the jacket is able to prevent or deter unauthorized access to the hollow interior of the vault of the automated teller machine comprises configuring the jacket such that the jacket is able to be coupled to the exterior surface of the automated teller machine;

and configuring the jacket such that the jacket is able to be coupled to the exterior surface of the automated teller machine comprises configuring at least one of the multiple armor panels to be coupled to the exterior surface of the automated teller machine.

19. The method of claim 18 wherein:

providing the multiple armor panels of the jacket comprises:

providing a rear armor panel section;

providing a right armor panel section; and providing a left armor panel section;

and at least one of:

the right armor panel section comprises a right foot configured to be coupled to an other surface separate from the jacket and the automated teller machine, and the right armor panel section and the right foot form one first continuous piece when the jacket is decoupled from the exterior surface of the automated teller machine;

the left armor panel section comprises a left foot configured to be coupled to the other surface separate from the jacket and the automated teller machine, and the left armor panel section and the left foot form one second continuous piece when the jacket is decoupled from the exterior surface of the automated teller machine; or the rear armor panel section comprises a rear foot configured to be coupled to the other surface separate from the jacket and the automated teller machine, and the rear armor panel section and the rear foot form one third continuous piece when the jacket is decoupled from the exterior surface of the automated teller machine.

20. The method of claim 18 wherein:

providing the multiple armor panels of the jacket comprises:

providing a rear armor panel section;

providing a right armor panel section; and providing a left armor panel section;

the multiple first armor panel unit sections comprise the rear armor panel section, the right armor panel section, and the left armor panel section; and the rear armor panel section, the right armor panel section, and the left armor panel section form a single unitary body when the multiple first armor panel unit sections are decoupled from the exterior surface of the automated teller machine.

21. A system comprising:

a jacket comprising multiple armor panels;

wherein:

the jacket is configured to be affixed to an exterior surface of an automated teller machine, the automated teller machine comprising the exterior surface and a vault that comprises a hollow interior;

the exterior surface of the automated teller machine comprises multiple side panels, the multiple side panels being arranged in different planes relative to each other;

at least one of the multiple armor panels is configured to be affixed to the exterior surface of the automated teller machine in order to affix the jacket to the exterior surface of the automated teller machine;

the multiple side panels comprise a front side panel, a rear side panel, a right side panel, and a left side panel;

the multiple armor panels comprise a first armor panel unit;

the first armor panel unit comprises multiple first armor panel unit sections;

the multiple armor panels comprise a front armor panel section, a rear armor panel section, a right armor panel section, and a left armor panel section corresponding to the front side panel, the rear side panel, the right side panel, and the left side panel;

the right armor panel section comprises a right foot configured to be affixed to an other surface separate from the jacket and the automated teller machine, and the right armor panel section and the right foot form one first continuous piece when the jacket is separate from the exterior surface of the automated teller machine;

the left armor panel section comprises a left foot configured to be affixed to the other surface separate from the jacket and the automated teller machine, and the left armor panel section and the left foot form one second continuous piece when the jacket is separate from the exterior surface of the automated teller machine; and the rear armor panel section comprises a rear foot configured to be affixed to the other surface separate from the jacket and the automated teller machine, and the rear armor panel section and the rear foot form one third continuous piece when the jacket is separate from the exterior surface of the automated teller machine and when the jacket is affixed to the exterior surface of the automated teller machine:

the multiple first armor panel unit sections correspond to and abut different side panels of the multiple side panels at the exterior surface of the automated teller machine such that the multiple first armor panel unit sections wrap continuously about the exterior surface to cover the different side panels of the multiple side panels;

and the jacket is configured to at least one of prevent or deter unauthorized access to the hollow interior of the vault of the automated teller machine.

* * * * *